US006195075B1

(12) United States Patent
Shino et al.

(10) Patent No.: US 6,195,075 B1
(45) Date of Patent: Feb. 27, 2001

(54) PLASMA DISPLAY DEVICE AND METHOD FOR DRIVING THE SAME

(75) Inventors: Taichi Shino, Ikoma-gun; Hajime Mae, Osaka; Kazunori Hirao, Yao; Yukiharu Ito, Takatsuki; Naoki Kosugi, Kyoto, all of (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/116,114

(22) Filed: Jul. 15, 1998

Related U.S. Application Data

(62) Division of application No. 08/640,414, filed on Apr. 30, 1996, now Pat. No. 5,872,425.

(30) Foreign Application Priority Data

Aug. 31, 1995 (JP) ..... 7-224211

(51) Int. Cl.[7] ..... G09G 03/28

(52) U.S. Cl. ..... 345/68; 345/61; 345/65; 345/67; 345/71; 345/60

(58) Field of Search ..... 313/484–86, 490–91, 313/492–93, 581–586, 587; 345/60, 67, 71, 87, 65, 68

(56) References Cited

U.S. PATENT DOCUMENTS

| | | | |
|---|---|---|---|
| 4,213,072 | | 7/1980 | Veith et al. . |
| 5,420,602 | * | 5/1995 | Kanazawa ..... 345/67 |
| 5,661,501 | | 8/1997 | Tanamochi . |
| 5,747,939 | | 5/1998 | Kim et al. . |

FOREIGN PATENT DOCUMENTS

| | | |
|---|---|---|
| 56-084848 | 7/1981 | (JP) . |
| 6-162934 | 6/1994 | (JP) . |
| 7-182979 | 7/1995 | (JP) . |
| 7-192635 | 7/1995 | (JP) . |

OTHER PUBLICATIONS

"Twenty–Five Inch Diagonal High–Contrast Color Plasma Display Panels", by Kozo Fujii, Hideo Sawai, Yoshimichi Takano and Tetsuo Sakai, *Electronics & Communications In Japan, Part II—Electronics,* vol. 77, No. 10, pp. 94–103, Oct. 1994.

"High Luminance and High Luminous Efficiency in Barrier–Electrode Color ac Plasma Displays Fabricated by Sandblasting Technology", by Y. Kawai, H. Uchiike, T. Takamori, K. Matsuoka, K. Lin and T. Sasaki, *1995 SID International Symposium Digest of Technical Papers,* pp. 815–818, May 23, 1995.

* cited by examiner

*Primary Examiner*—Nimeshkumar D. Patel
*Assistant Examiner*—Mack Haynes
(74) *Attorney, Agent, or Firm*—Akin, Gump, Strauss, Hauer & Feld, L.L.P.

(57) ABSTRACT

In a plasma display device having a three-dimensional matrix wiring arrangement of anodes, cathodes and address electrodes, writing discharge is caused between anodes and address electrodes to temporarily store writing charge on a dielectric layer, and the writing charge is discharged as an auxiliary discharge by applying a sustaining voltage to the cathodes, thereby inducing main discharge between the anodes and the cathodes.

7 Claims, 23 Drawing Sheets

PLASMA DISPLAY DEVICE AND METHOD FOR DRIVING THE SAME

This is a division of U.S. patent application Ser. No. 08/640,414, filed Apr. 30, 1996, now U.S. Pat. No. 5,872,425, entitled "Plasma Display Device And Method For Driving The Same".

FIELD OF THE INVENTION AND RELATED ART STATEMENT

1. Field of the Invention

The present invention relates to a plasma display device used for image display on TV, advertisement display boards, etc., and a method of driving the same.

2. Description of the Related Art

FIG. 20 is a perspective view showing a conventional plasma display device. A similar configuration is described in Japanese unexamined patent publication (TOKKAI) Hei6-162934, for example. In FIG. 20, an insulating substrate 1 has arranged thereon a plurality of anodes 4 in the form of stripe each having a plurality of resistors 2 and electrode members 3. A plurality of auxiliary anodes 5 having a shape of stripe are arranged in parallel to the anodes 4. The anodes 4 are covered with an insulating layer 6.

A reset cathode 8 and a plurality of cathodes 9, which are arranged in parallel to the reset cathode 8, are formed on a lower face of a transparent glass substrate 7. The cathodes 9 and the reset cathode 8 are disposed above and crossed with the anodes 4 and the auxiliary anodes 5. A plurality of discharge cells 11 are formed in spaces defined by a partition wall 10 between the anodes 4 and the cathodes 9 facing each other. Also, an auxiliary discharge cell 13 is formed in a space defined by crossing alignment of the auxiliary anodes 5 on one hand and the reset cathode 8 and the cathodes 9 on the other hand. The auxiliary discharge cell 13 communicates with the discharge cells 11 through communication holes 12. At least a part of the electrode members 3 of the anodes 4 in the discharge cells 11 faces discharge holes 14 formed in the insulating layer 6 and is thus exposed toward the cathodes 9.

To perform a monochromatic display by this plasma display device, a rare gas such as neon or argon is sealed in the discharge cells 11 and the auxiliary discharge cell 13. Display is performed using a color generated by discharge illumination of the gas. For multicolor display, on the other hand, a phosphor layer 15 is formed on faces of the insulating layer 6 and the partition wall 10 in each of discharge cells 11, and a rare gas such as helium, neon or argon containing at least xenon is sealed in the discharge cells 11 and the auxiliary discharge cell 13. The phosphor layer 15 is excited by the ultraviolet rays generated by the discharge in the gas, and display performed by the illumination color generated from the phosphor layer 15.

The above-mentioned plasma discharge device is what is called pulse-memory-type device, and it has a matrix circuit as shown in FIG. 21. In FIG. 21, a row of reset cathode R and N (=integer) rows of cathodes $K_1$to $K_N$ are arranged along the rows. Along the column length, on the other hand, there are arranged M (=integer) columns of anodes $A_1$ to $A_M$ and L (=integer) columns of auxiliary anodes $H_1$ to $H_L$. FIG. 22 is a time chart showing driving voltages supplied to respective parts described above. Operation of image display is hereafter described with reference to these figures.

First, during the first period $t_1$, the auxiliary anodes $H_1$ to $H_L$ and the reset cathode R are impressed with pulse voltages of opposite phases to each other, thereby to cause a reset discharge between the auxiliary anodes $H_1$ to $H_L$ and the reset cathode R. Since a stable reset discharge hardly generates by only one application of pulse voltage, the pulse voltage is repeatedly applied to during the period $t_1$ to trigger a stable reset discharge.

Next, during the scanning period $t_3$, a pulse voltage is applied to the auxiliary anodes $H_1$ to $H_L$ and the cathode $K_1$, and a writing pulse voltage is applied to the anodes $A_1$ to $A_M$ corresponding to the display discharge cells respectively. As a result, the residual charged particles due to the reset discharge trigger a stable auxiliary discharge between the auxiliary anodes $H_1$ to $H_L$ and the cathode $K_1$. Further, this auxiliary discharge induces a stable main discharge in the display discharge cells.

The operation for sustaining the main discharge of the display discharge cells is performed by applying a sustaining pulse voltage to the cathode $K_1$ again during the period $t_6$ when sufficient residual charge particles remain due to the main discharge occurred during the period $t_3$. Similarly, as far as the sustaining pulse voltage continues to be applied to the cathode $K_1$ during the periods $t_8$, $t_{10}$, . . . , the main discharge of the display discharge cells is performed intermittently and thus sustained.

During the next scanning period $t_5$, a pulse voltage is applied to the auxiliary anodes $H_1$ to $H_L$ and the cathode $K_2$, and a writing pulse voltage is applied to the anodes $A_1$ to $A_M$ which respectively correspond to the display discharge cells. Consequently, the residual charged particles generated by the auxiliary discharge between the auxiliary anodes $H_1$ to $H_L$ and the cathode $K_1$ trigger a stable auxiliary discharge between the auxiliary anodes $H_1$ to $H_L$ and the cathode $K_2$. Further, the thus occurred auxiliary discharge induces a stable main discharge of the display discharge cells.

For sustaining the main discharge of the display discharge cells, a sustaining pulse voltage is applied to the cathode $K_2$ again during the period $t_8$ when a sufficient amount of residual charged particles remain due to the main discharge which has been generated during the period $t_5$. The main discharge is thus triggered again in the display discharge cells. In the similar manner, as far as a sustaining pulse voltage continues to be applied to the cathode $K_2$ during the period $t_{10}$, $t_{12}$, . . . , the main discharge of the display discharge cells is performed intermittently and thus sustained.

Further, the above-mentioned operation is performed by sequentially scanning the cathodes $K_3$, $K_4$, . . . which are successively arranged along the rows, thereby forming a screen of image. In this scanning process, the auxiliary discharge during the period $t_5$, $t_7$, . . . following the period $t_3$ is succeeded with the aid of the charged particles due to the just preceding auxiliary discharge.

FIG. 23 is a diagram for explaining operation of the conventional plasma display device shown in FIG. 20 when a grayscale TV picture is displayed thereon. In FIG. 23, an image display has 500 TV lines (i.e., 500 scanning lines), 256 gradations and a field period $t_f$ of 1/60 second. One field can be divided into eight subfields having time periods equal to each other. The writing pulse and the sustaining pulse are alternately applied to the device for each scanning time of one field scanning. The writing period in one scanning cycle is $t_{s1}$, and a sustaining period in each scanning cycle is $t_{s2}$.

Writing and sustaining pulse periods are obtained from a relation expressed as (1/60 [second])/(500[TV lines])/(8 [subfields]), which is equal to about 4 $\mu$ seconds. Also, the maximum number of times each subfield contains $2^8$ (=128)

pulses is obtained from a relation given as $500 \geqq 128 \times N$ (N: integer), and this leads to a result of N=3. To apply the writing pulse and the sustaining pulse so as not to overlap each other, the maximum time Σm made available for sustaining discharge is given as $$1[\mu\text{second}]\times(128+64+32+16+8+4+2+1)\times 3 \text{ (N: number of times)} = 765\ [\mu\text{seconds}].$$

Therefore, the maximum time Σm to the field period $t_f$ is about 1/20 from a relation (765 [μseconds])/(1/60 [second]) for each field period.

As shown in graph (a) of FIG. 23, the conventional subfield arrangement makes it necessary to perform the auxiliary discharge continuously according to the scanning sequence of the cathodes over the entire subfield period. For this reason, a field period $t_f$ is divided into eight equal subfields, and an idle time is provided as a difference between the subfield period and the sustaining period. Due to presence of the idle time, the writing periods and the sustaining periods are not fully packed during each field period $t_f$. The sustaining discharge period is reduced accordingly. When one scanning period is considered, the result is that the maximum time Σm made available for sustained discharge is about 1/20 of the field period $t_f$, as described above. Consequently, the maximum value of the sustained discharge current is about 20 times as large as an average value thereof. On the other hand, intermittent sustained discharge is maintained by intermittent but continual application of a sustaining pulse voltage. Therefore, on the assumption that the discharge current during the sustained discharge period is averaged by a smoothing circuit, since the pulse period of the writing and sustaining operations is 4 μseconds, the sustaining period for each scan in one field period $t_f$ is given as $$4\ [\mu\text{seconds}]\times(128+64+32+16+8+4+2+1)\times 3\ [\text{N: times}].$$

This value is about 3 milliseconds. Also, in view of the fact that the writing period with respect to the entire scanning period is equal to a field period $t_f$, and therefore the sustained discharge current for the entire scanning cycle is effectively averaged. The effective sustaining period during each field period is therefore about 4 milliseconds. The maximum time Σm available for effective sustained discharge is thus about 1/4 of a field period $t_f$. This shows that as shown in graph (b) of FIG. 23, a current capacity of a power supply for supplying a sustained discharge current is required to afford a current of about four times (4 on relative scale) as large as the average current (1 on relative scale) required.

However, there are some shortcomings in the above-mentioned conventional plasma display device of pulse memory type. First, it is required in the sustaining operation to apply a sustaining pulse voltage many times to the cathodes 9 ($K_1$ to $K_N$) while a sufficient amount of residual charged particles are present, thereby to intermittently sustain the main discharge of the display discharge cells. For this reason, a reactive current caused by the sustaining pulse voltage frequently flows through a capacitive load including inter-electrode capacitances of the plasma display device in addition to the discharge current during the application of the sustaining pulse voltage, resulting in considerable power consumption.

Also, a panel structure is complicated due to the fact that the auxiliary discharge requires the auxiliary discharge cells 13 communicating with the discharge cells 11 in the space defined by the auxiliary anodes 5, the reset cathode 8 and the cathodes 9 parallel to the reset cathode 8. In addition, since the auxiliary discharge cells 13 do not contribute to displaying, presence of the auxiliary discharge cells 13 is an undesirable adverse factor against improvement of a resolution in image display.

Also, there are only the reset cathode 8 and the cathodes 9 on the transparent glass substrate 7, whereas the insulating substrate 1 has arranged thereon the resistors 2, the anodes 4 having the electrode members 3, the auxiliary anodes 5, the partition walls 10 and the insulating layer 6, and in addition, the phosphor layer 15 when multicolor display is intended. The result is a very complicated configuration on the insulating substrate 1 as compared with the configuration on the glass substrate 7.

Another problem is that since the pulse voltage for the auxiliary anodes 5 ($H_1$ to $H_L$) is required to rise within a short time, the pulse voltage is applied directly to the auxiliary anodes 5 ($H_1$ to $H_L$). The reason for the direct application of the pulse voltage is that if the direct application is avoided by additionally providing an external circuit of the auxiliary anodes 5 ($H_1$ to $H_L$) with a resistor for limiting the discharge current, the rise of the pulse voltage is dulled due to the stray capacitance formed in the plasma display device. However, when a pulse voltage is directly applied to the auxiliary anodes 5 ($H_1$ to $H_L$), increase of the discharge current is accelerated with the lapse of operation time. Therefore, power consumption of the auxiliary discharge is considerably large, thereby shortening a life time of the device.

Further, the residual charged particles of the auxiliary discharge between the just preceding cathode $K_1$ and the auxiliary anodes $H_1$ to $H_L$ are utilized to secure stable auxiliary discharge between the auxiliary anodes $H_1$ to $H_L$ and the cathode $K_2$. In other words, the auxiliary discharge for the current row is stabilized always by the auxiliary discharge for the preceding row. The auxiliary discharge is therefore required to be continuously performed in the scanning sequence of the cathodes $K_1$, $K_2$, . . . For this reason, the only method of grayscale display on the screen that can be employed is to perform the above-described sequence of shifting the auxiliary discharge. As a result, a rate of the sustained discharge time is low in one field period, and it is difficult to obtain a high luminance and a low power consumption. Besides, the maximum value of the sustained discharge current is very high, so that volume, weight and cost of the power supply for supplying current to the device are inevitably large.

OBJECT AND SUMMARY OF THE INVENTION

As described above, in the conventional plasma display device and method for driving the plasma display device, it is an object how the device configuration is simplified and the power consumption is reduced while improving the efficiency and luminance.

An object of the invention is to offer a plasma display device and a method for driving the plasma display device capable of solving the above-mentioned object.

In order to achieve the above-mentioned object, a plasma display device of the present invention has, between first and second substrates spaced and faced each other, electrode groups forming an arrangement of rows and columns in two level crossing with a space therebetween and walls for partitioning the space and defining a plurality of small areas of discharge cells sealing a gas, and the device is characterized by comprising:

a plurality of address electrodes forming a stripe shape arranged in a plurality of columns on the first substrate;

a dielectric layer provided on the address electrodes;

a plurality of anodes forming a stripe shape arranged in a plurality of rows on the dielectric layer to face the address electrodes through the dielectric layer;

a plurality of cathode buses forming a stripe shape arranged on the second substrate;

a plurality of cathodes connected to each of the cathode buses each through a resistor for each of the discharge cells and each arranged in the form of a small piece at a position facing one of the anodes and one of the address electrodes on the second substrate, the cathodes being aligned along the rows to form an arrangement of a plurality of rows as a whole;

an insulating layer provided on the cathode electrode buses and the cathodes and including a plurality of discharge holes formed at positions corresponding to the cathodes respectively; and a plurality of partition walls formed between the insulating layer and the anodes for defining and partitioning a space between the anodes and the cathodes and thereby forming the discharge cells.

According to the above-mentioned configuration, structure of a plasma display device is simplified. Therefore, a screen resolution can be increased. Also, fabrication efficiency is improved and a cost is reduced.

Instead of the above-mentioned configuration, the device may be characterized by comprising:

a plurality of address electrodes forming a stripe shape arranged in a plurality of rows on the first substrate;

a dielectric layer provided on the address electrodes;

a plurality of anodes forming a stripe shape arranged in a plurality of columns on the dielectric layer to face the address electrodes through the dielectric layer;

a plurality of cathode buses forming a stripe shape arranged on the second substrate;

a plurality of cathodes connected to each of the cathode buses each through a resistor for each of the discharge cells and each arranged in the form of a small piece at a position facing one of the anodes and one of the address electrodes on the second substrate, the cathodes being aligned along the rows to form an arrangement of a plurality of rows as a whole;

an insulating layer provided on the cathode electrode buses and the cathodes and including a plurality of discharge holes formed at positions corresponding to the cathodes respectively; and a plurality of partition walls formed between the insulating layer and the anodes for defining and partitioning a space between the anodes and the cathodes and thereby forming the discharge cells.

In another aspect, the present invention is a method for driving a plasma display device having a three-dimensional matrix wiring arrangement of anodes, cathodes and address electrodes, comprising the steps of:

(a) applying a scanning pulse voltage to the anodes and a writing pulse voltage to the address electrodes, thereby to cause writing discharge and temporarily store writing charge on a dielectric layer around the anodes;

(b) discharging the writing charge as an auxiliary discharge by applying a sustaining voltage to the cathodes; and (c) inducing main discharge between the anodes and the cathodes by the auxiliary discharge and sustaining the main discharge by continuously applying the sustaining voltage.

Within a scope of the above-mentioned method, the following procedure is also applicable:

the scanning pulse voltage is applied to each of the anodes, thereby causing the writing discharge and temporarily storing the writing charge on the dielectric layer around each of the a nodes, and immediately after completion of storing the writing charge to one of the anodes, the steps (b) and (c) are executed, thereby causing the main discharge between the cathode and the corresponding a node, and the steps (b) and (c) are sequentially performed so as to follow the timing of completion of storing the writing charge for every anode.

Also, the present invention may be a method for driving a plasma display device having a three-dimensional matrix wiring arrangement of anodes, cathodes and address electrodes, comprising the steps of:

applying a scanning pulse voltage to the address electrodes and a writing pulse voltage to the anodes, thereby to cause writing discharge and temporarily store writing charge on a dielectric layer around the anodes;

discharging the writing charge as an auxiliary discharge by applying a sustaining voltage to the cathodes; and inducing main discharge between the anodes and the cathodes by auxiliary discharge and sustaining the main discharge by continuously applying the sustaining voltage.

In the step of discharging, the sustaining voltage may be sequentially applied to a plurality of small groups of the cathodes having a configuration of a plurality of rows so that the main discharge will be caused between each small group of cathodes impressed with the sustaining voltage and corresponding anodes.

According to the above-mentioned method, a power consumption for auxiliary discharge is reduced, thereby lengthening the service life of the device.

Further, since the sustained discharge is effected by a continuous sustaining voltage, the reactive power loss based on an inter-electrode capacity can be reduced. In addition, the writing operation and the sustaining operation are performed independently of each other. Thus, the driving operation can be accomplished with a very small wasteful time which does not contribute to illumination. An optical energy can therefore be taken out efficiently from the discharge cells, thereby improving an illumination efficiency. In this way, a plasma display device can be driven with a high luminance and a small power consumption.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENTS

First Embodiment of the Device

Figure 1:
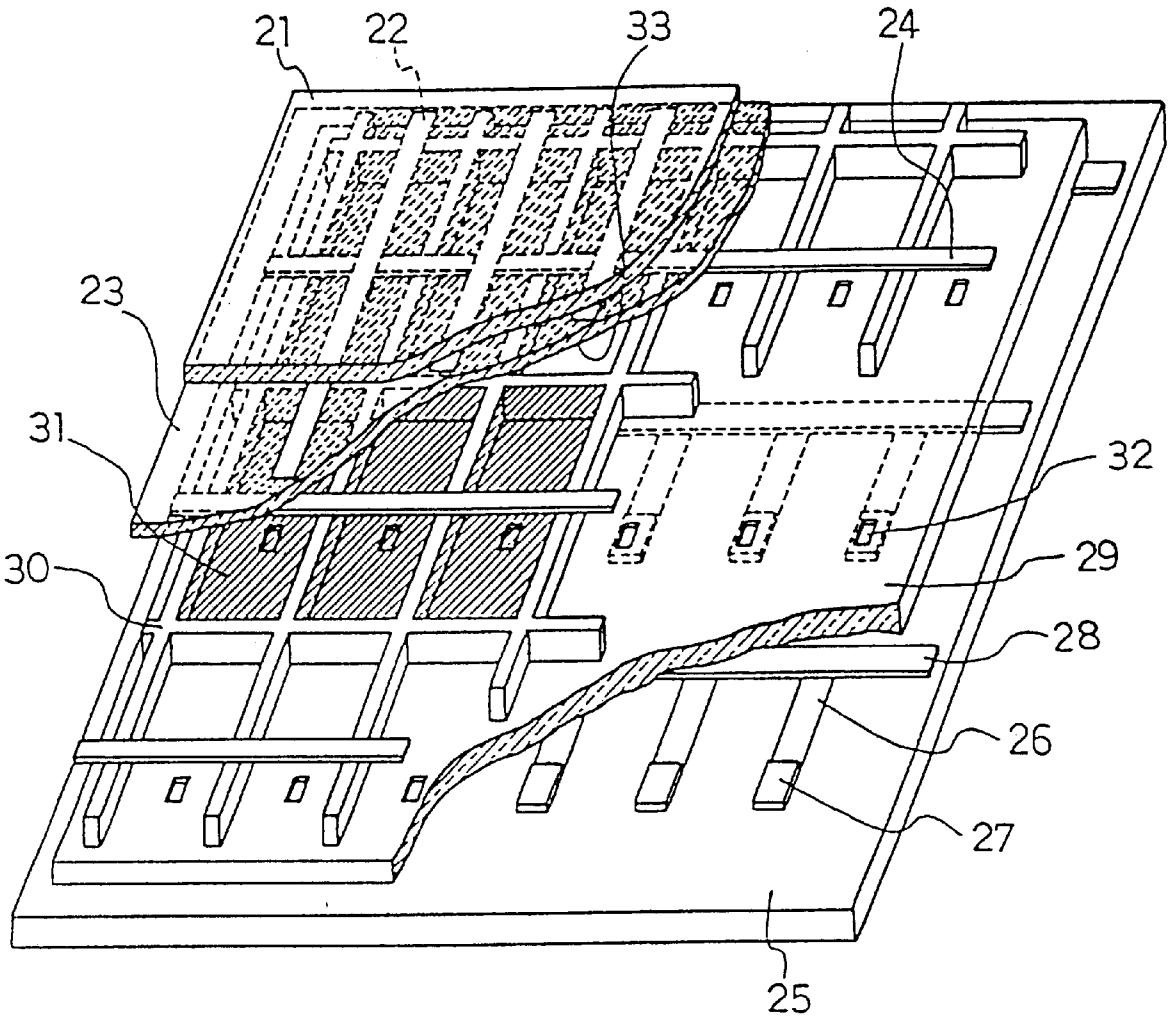
FIG. 1 is a perspective view of a plasma display device in a first embodiment of the present invention.

FIG. 1 is a perspective showing a plasma display device in a first embodiment of the present invention. In FIG. 1, a plurality of address electrodes 22 arranged in stripe shape, a dielectric layer 23 and a plurality of anodes 24 arranged in stripe shape are formed in layers on a lower face of an insulating substrate 21. The anodes 24 are disposed perpendicular to the address electrodes 22, and they (22 and 24) form a two level crossing with each other. A plurality of cathode buses 28 arranged in stripe shape, each of which includes plural resistors 26 and small cathodes 27, are provided on a transparent glass substrate 25. An insulating layer 29 is laid on this assembly. The cathode buses 28 are disposed perpendicular to the address electrodes 22 with the dielectric layer 23 and the insulating layer 29 therebetween. The cathodes 27 are located to face the address electrodes 22 and the anodes 24.

A space defined by the anodes 24 and the cathodes 27 faced each other is partitioned by parallel-cross-shaped partition walls 30 into a plurality of discharge cells 31 each having a small area. Discharge holes 32 are formed in the insulating layer 29 where the anodes 24 and the cathodes 27 are faced each other so that at least a part of each of the cathodes 27 can be exposed to the space of the corresponding discharge cell 31. The anodes 24 are arranged to face the address electrodes 22 at their crossing points formed in matrix alignment, thereby to have the charge accumulated at least in an area on a face of the dielectric layer 23 which is adjacent to the anodes 24. The discharge cells 31 have sealed therein at least selected one of discharge rare gases including helium, neon, argon, xenon and krypton.

As apparent from the foregoing description, the electrodes constitute an arrangement of a plurality of rows and columns in two level crossing. More specifically, the address electrodes 22 are arranged in a plurality of columns, and the anodes 24 are arranged in a plurality of rows. The anodes 24 are arranged perpendicular to the address electrodes 22 to form a two level crossing of them. The cathodes 27 connected to the same one of the cathode buses 28 are aligned on a straight line parallel to each of the anodes 24, thereby constituting as a whole an arrangement of plural rows.

To perform monochromatic display by the plasma display device described above, at least selected one of rare gases including neon, argon and the like is sealed in the discharge cells 31 to produce an illumination display color of the selected gas when a discharge is generated.

If it is necessary to perform multicolor display apart from this embodiment, a phosphor layer 33 is formed on each face of the partition walls 30 and a portion of the dielectric layer 23 adjacent to the anode 24 in the discharge cells 31. The discharge cells 31 have sealed therein at least one of the discharge rare gases including helium, neon, argon, xenon and krypton. The phosphor layer 33 is excited by the ultraviolet rays generated by the discharge of such a gas, thereby displaying an image in color illuminated from the phosphor layer 33.

The resistors 26 can be formed by a thick-film printing method with a metal or a metal oxide film as a raw material. To more efficiently transmit light, a thin film may be formed of a transparent material such as ITO or $SnO_2$ by means of the electron beam process, sputtering or CVD process etc.

If the display device is designed as the one to be viewed from a side of the insulating substrate 21 contrary to the embodiment, the insulating substrate 21 may consists of a transparent glass substrate, and the address electrodes 22 and the anodes 24 may be formed as a thin film of a transparent material such as ITO and $SnO_2$.

As has been described in the related art statement, the conventional plasma display device has a very complicated configuration on one side of a substrate. In contrast, the plasma display device of this embodiment has a simple configuration due to absence of auxiliary discharge cells.

Also, the configuration on the insulating substrate 21 includes the address electrodes 22, the dielectric layer 23, the anodes 24, the partition walls 30 and optionally a phosphor layer 33 when the multicolor display is intended. On the other hand, the configuration on the glass substrate 25 includes the resistors 6, the cathodes 27, the cathode buses 28 and the insulating layer 29. The configurations on both the substrates are thus simplified to the same extent.

Second Embodiment of the Device

Figure 2:
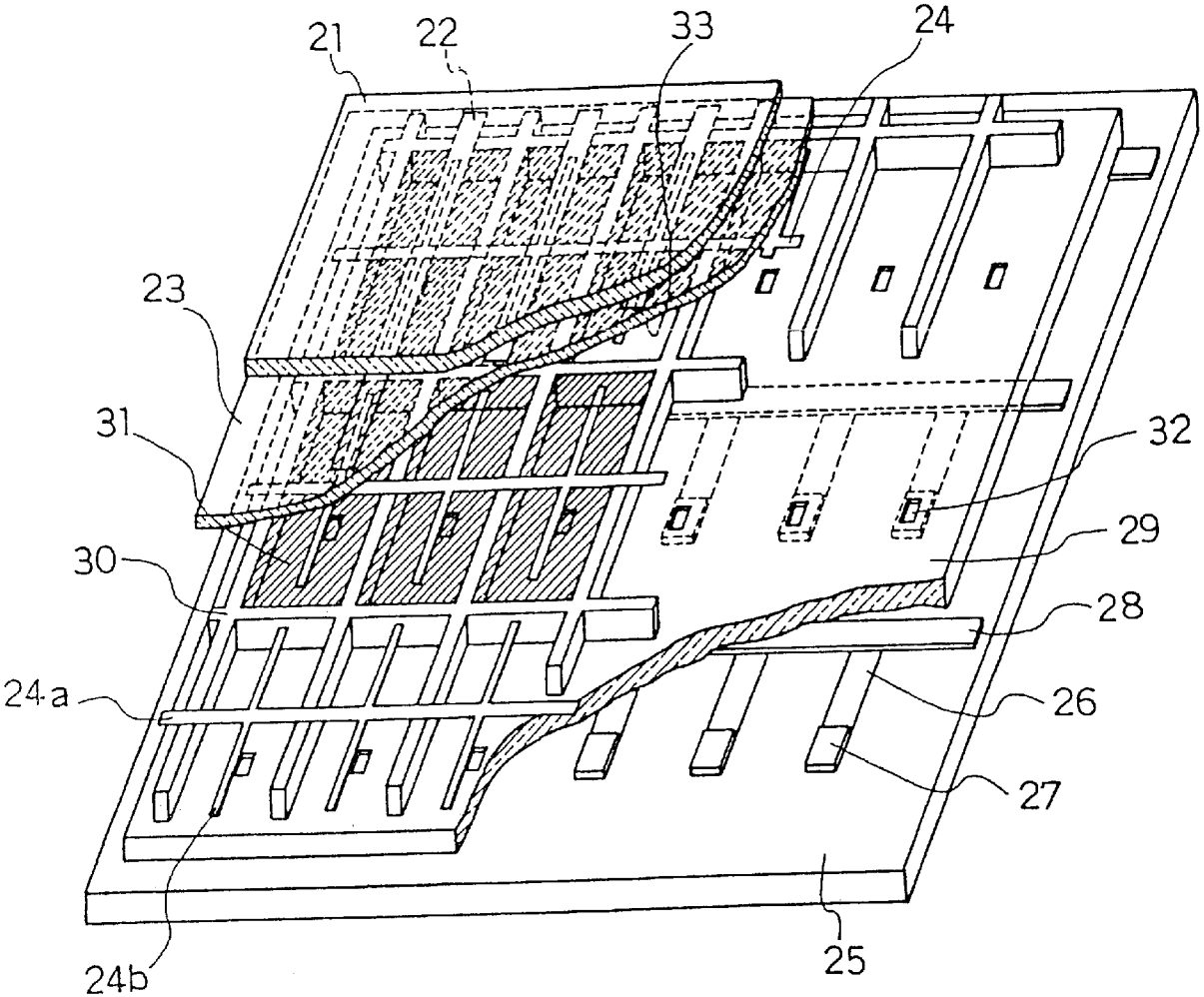
FIG. 2 is a perspective view of a plasma display device in a second embodiment of the present invention.

FIG. 2 is a perspective view showing a plasma display device in a second embodiment. In the present embodiment having the same configuration as the first embodiment excepting that a shape of the anode 24 is different, the description as set forth in the first embodiment is applied to the same component parts with the same reference numbers.

In FIG. 2, each of the anodes 24 has a bus 24*a*, and the bus 24*a* has a plurality of branches 24*b*. The buses 24*a* constitute as a whole a stripe shape in parallel to the cathode buses 28. With respect to each of the buses 24*a*, the branches 24*b* are formed in the same plane as the bus 24*a* for the respective discharge cells 31 and extended in a direction perpendicular to the bus 24*a*, thereby forming a cross in each of the discharge cells 31. Coordinate points of intersection between the buses 24*a* and the branches 24*b* are located substantially just above the corresponding discharge hole 32, respectively.

The anodes 24 constructed as above-mentioned operate to facilitate discharge by expanding an electric field distribution to be formed in each of the discharge cells 31.

Third Embodiment of the Device

Figure 3:
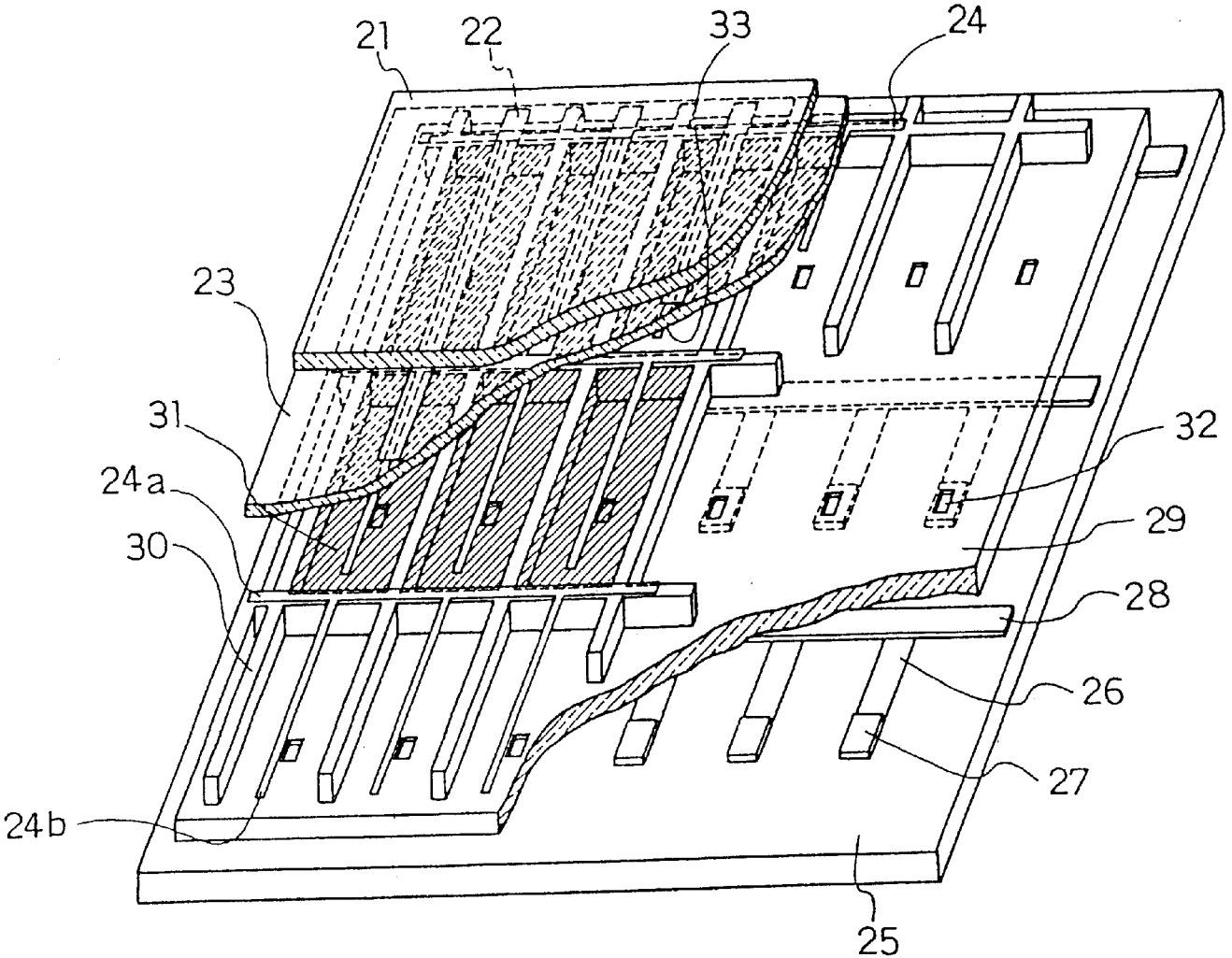
FIG. 3 is a perspective view of a plasma display device in a third embodiment of the present invention.

FIG. 3 is a perspective view showing a plasma display device in a third embodiment. This embodiment has the same configuration as the first embodiment except that a shape of the anode 24 is different, and therefore the description set forth in the first embodiment is applied to the corresponding parts in this embodiment with the same reference numbers.

In FIG. 3, each of the anodes 24 has a bus 24*a*, and the bus 24*a* has a plurality of branches 24*b*. The buses 24*a* constitute as a whole a stripe shape in parallel to the cathode buses 28. With respect to each of the buses 24*a*, the branches 24*b* are formed in the same plane as the bus 24*a* for the respective discharge cells 32 and extended in a direction perpendicular to the bus 24*a*, thereby forming a T-shape in each of the discharge cells 31. Each of the branches 24*b* is arranged to pass a point substantially just above the corresponding discharge hole 32, i.e., which is a point capable of facing the cathode 27.

The anodes 24 constructed as above-mentioned operate to facilitate discharge by expanding an electric field distribution to be formed in each of the discharge cells 31 in a manner similar to the second embodiment.

Fourth Embodiment of the Device

Figure 4:
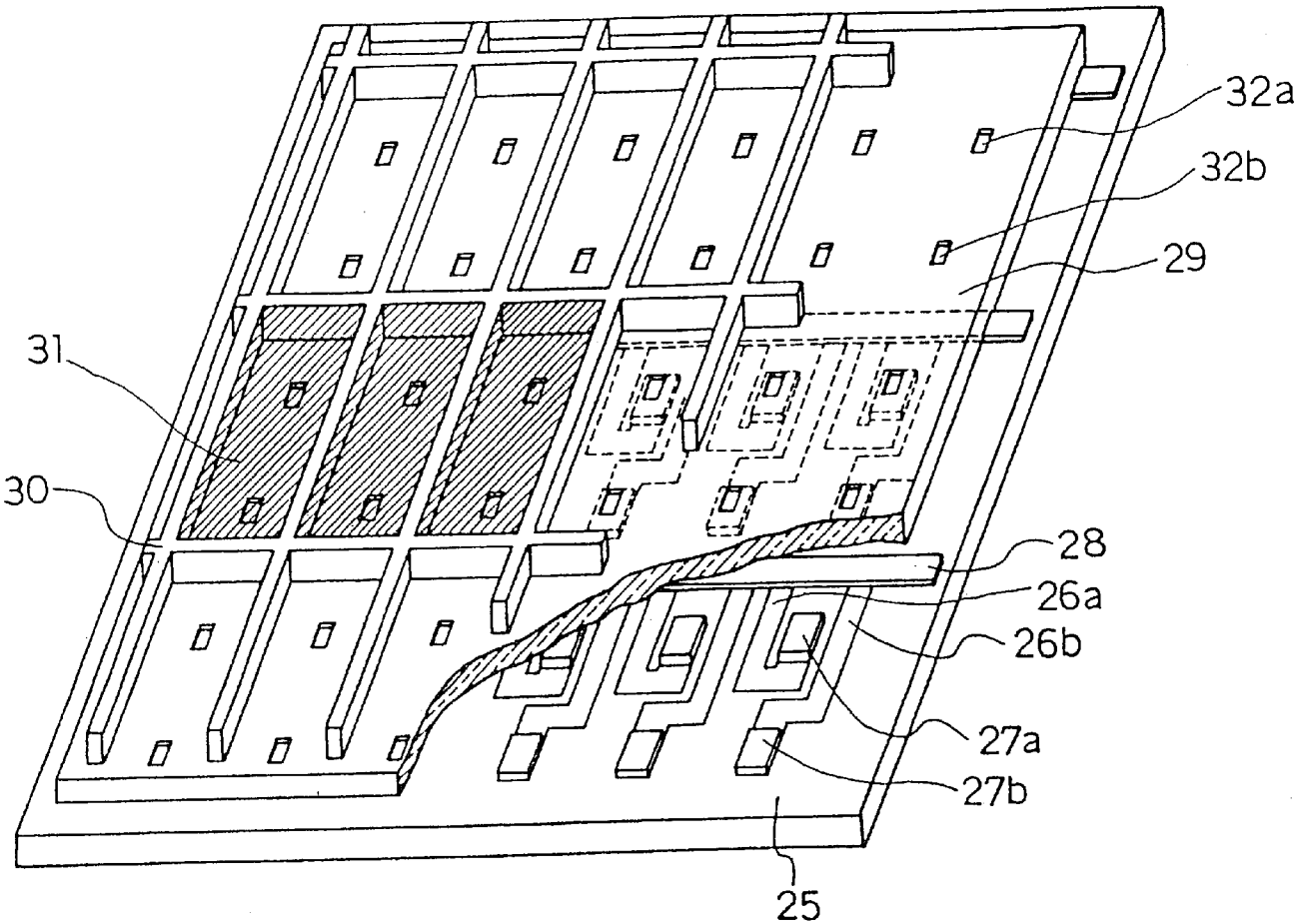
FIG. 4 is a perspective view of a plasma display device in a fourth embodiment of the present invention.

FIG. 4 is a perspective view showing a plasma display device in a fourth embodiment. The difference between the plasma display device according to this embodiment and that according to the first to third embodiments resides only in the configuration of the transparent glass substrate 25. The configuration of the other parts therefore can be applied to this fourth embodiment with any of the first to third embodiments. Therefore, only the configuration of the parts on the glass substrate 25 will be described with reference to FIG. 4.

In this fourth embodiment, parts on the glass substrate 25 are dispersively arranged for each of the discharge cells 31. That is, a pair of resistors 26*a*, 26*b* and cathodes 27*a*, 27*b* are provided for each of the discharge cells 31. The cathodes 27*a* and 27*b* mounted in the same discharge cell 31 are aligned on the same column. The cathodes 27*a* and 27*b* in each discharge cell 31 are connected to the corresponding cathode bus 28 through the two resistors 26*a* and 26*b*, respectively. Also, the insulating layer 29 has two discharge holes 32*a* and 32*b* at corresponding positions of the two cathodes 27*a* and 27*b* for each discharge cell 31, respectively. These discharge cells 32*a* and 32*b* have a hole size smaller than the cathodes 27*a* and 27*b*, respectively, so that the cathodes 27*a* and 27*b* are exposed partially. Resistance values of the resistors 26*a* and 26*b* are set equal to each other.

Figure 5:
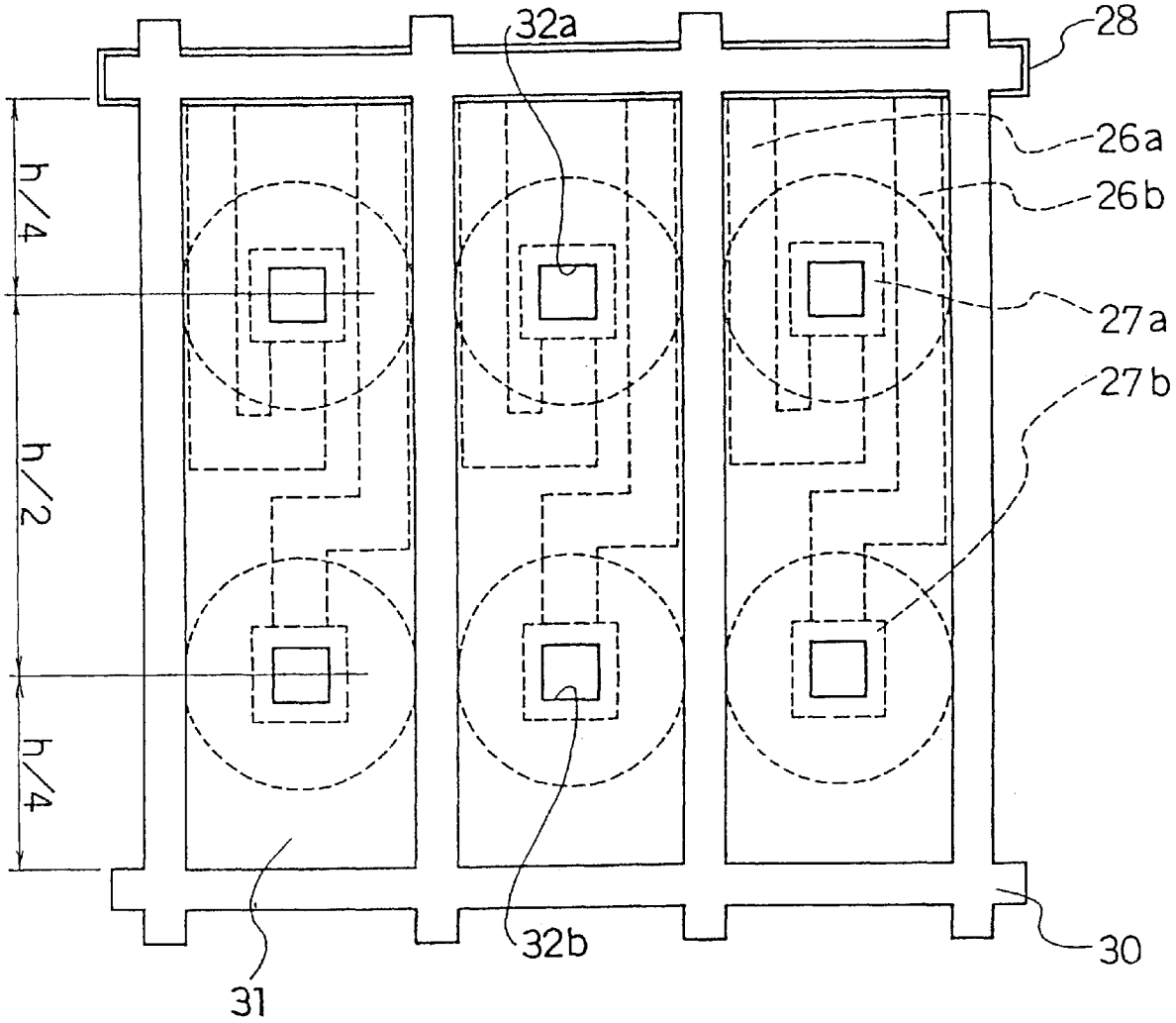
FIG. 5 is a plan view partially enlarged from FIG. 4.

FIG. 5 is an enlarged plan view showing the discharge holes 32*a* and 32*b* and their peripheries. When a length in the longitudinal direction of each discharge cell 31 is settle h, the two discharge holes 32*a* and 32*b* are arranged about h/4 away from the upper and lower ends thereof, respectively.

In the above-mentioned plasma display device, when a discharge voltage is applied in a given discharge cell 31 between the anode 24 (e.g., the branch 24*b* in FIG. 3) and the cathode bus 28 (FIG. 4), discharge occurs in two paths between the branch 24*b* and each of the two cathodes 27*a* and 27*b* (FIG. 4). The discharge current in the discharge cell 31 is divided into two equal parts through the two cathodes 27*a*, 27*b* and the two resistors 26*a*, 26*b* and flows into the cathode bus 28. The reason why the current is equally divided is described below.

That is, when the discharge current to one cathode increases beyond the current to the other cathode, voltage drop due to the resistor connected to the one cathode increases, and thereby the discharge current is suppressed. Therefore, the discharge current to the other cathode increases as a result. Thus, an effect of always averaging the two currents is obtained.

As described above, the discharge currents flowing in the two cathodes 27*a* and 27*b* are always equalized and stabilized. As compared with the case that the discharge occurs only at a single point, two discharge with a reduced discharge current by half occurs at two points in the discharge cell 31. As a result, an area contributing to illumination increases by a factor of approximately two. Also, reduction of each discharge current brings improvement of the illumination efficiency as described below.

Figure 6:
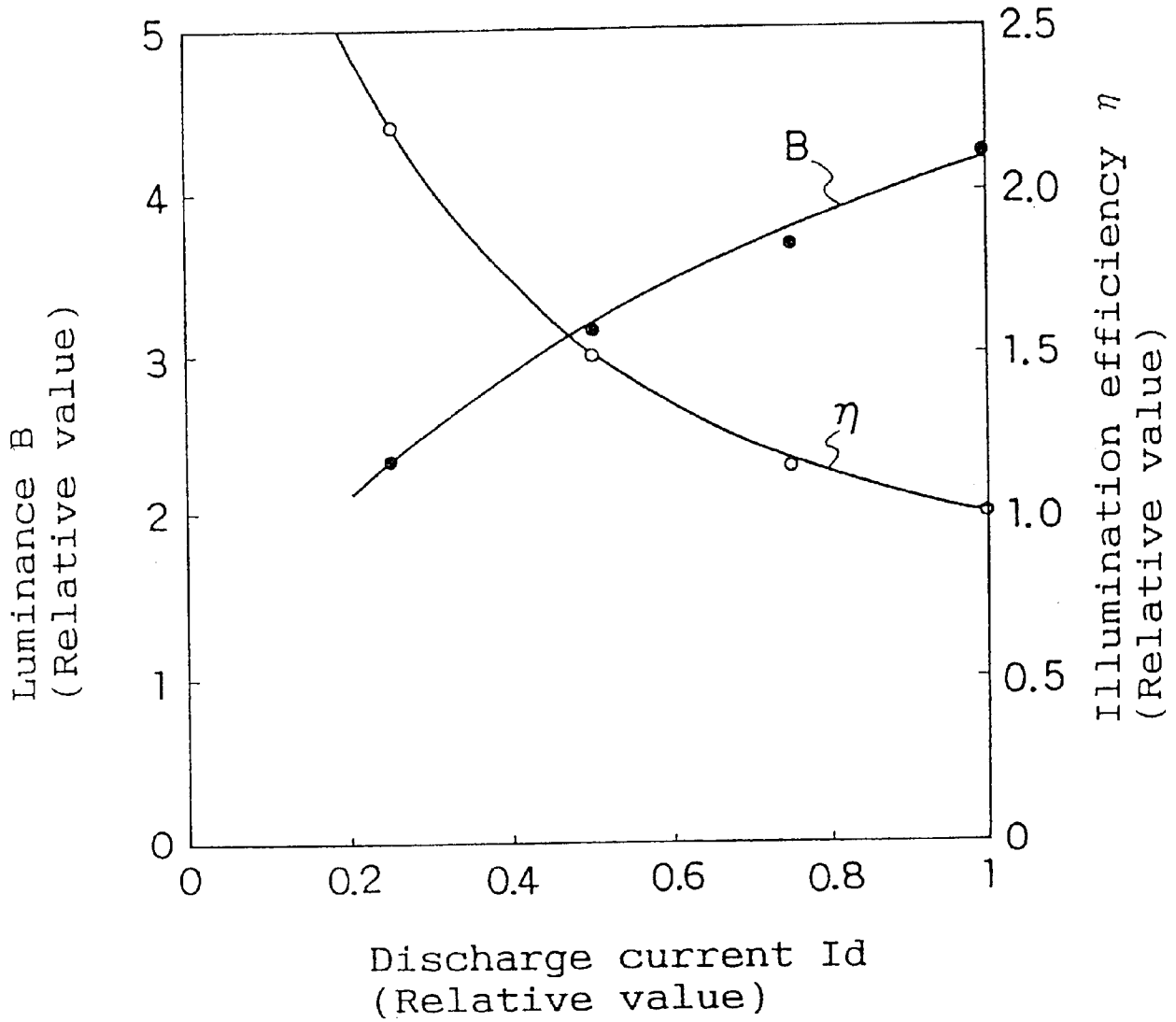
FIG. 6 is a characteristic diagram showing a relation between discharge current and luminance on one hand and a relation between discharge current and illumination efficiency on the other hand for the plasma display device in the present invention.

According to experiments conducted on a discharge cell of a working model in the size of 1.2 mm×0.4 mm, the relation between discharge current Id and luminance B was plotted by a curve B shown in FIG. 6. Also, the relation between the discharge current Id and the illumination efficiency $\eta$ was given by a curve $\eta$ in FIG. 6. When a discharge current Id decreases, an illumination efficiency $\eta$ is improved. According to the experiments, the illumination efficiency $\eta$ increases by a factor of about 1.5 when the discharge current Id is reduced by one half. By generating illumination at two points by a half discharge current in the discharge cell as described above, the illumination efficiency is improved by about 1.5 times. This indicates that the luminance can be improved by about 1.5 times with the same discharge power.

To perform multicolor display, as aforementioned, phosphor layers 33 may be formed on the face of the partition wall 30 and a part of the dielectric layer 23 adjacent to the anode 24 in the discharge cell 31 (FIG. 1, etc.). Each discharge cell 31 is formed into an elongated rectangle as shown in FIG. 5 so that three discharge cells 31 disposed adjacent to each other, which have phosphor layers 33 for illuminating red, blue and green, can constitute a substantially square pixel. The configuration of this fourth embodiment in which an illumination region is widened by generating illumination at two points for an improved illumination efficiency thus brings a conspicuous effect.

Of course, the effects obtained by the device in the first, second and third embodiments are also obtained in this fourth embodiment.

Apart from the fourth embodiment described above in which two cathodes and two resistors are provided for each discharge cell 31, three or more cathodes and three or more resistors may be included in the device to obtain a similar effect.

Fifth Embodiment of the Device

Figure 7:
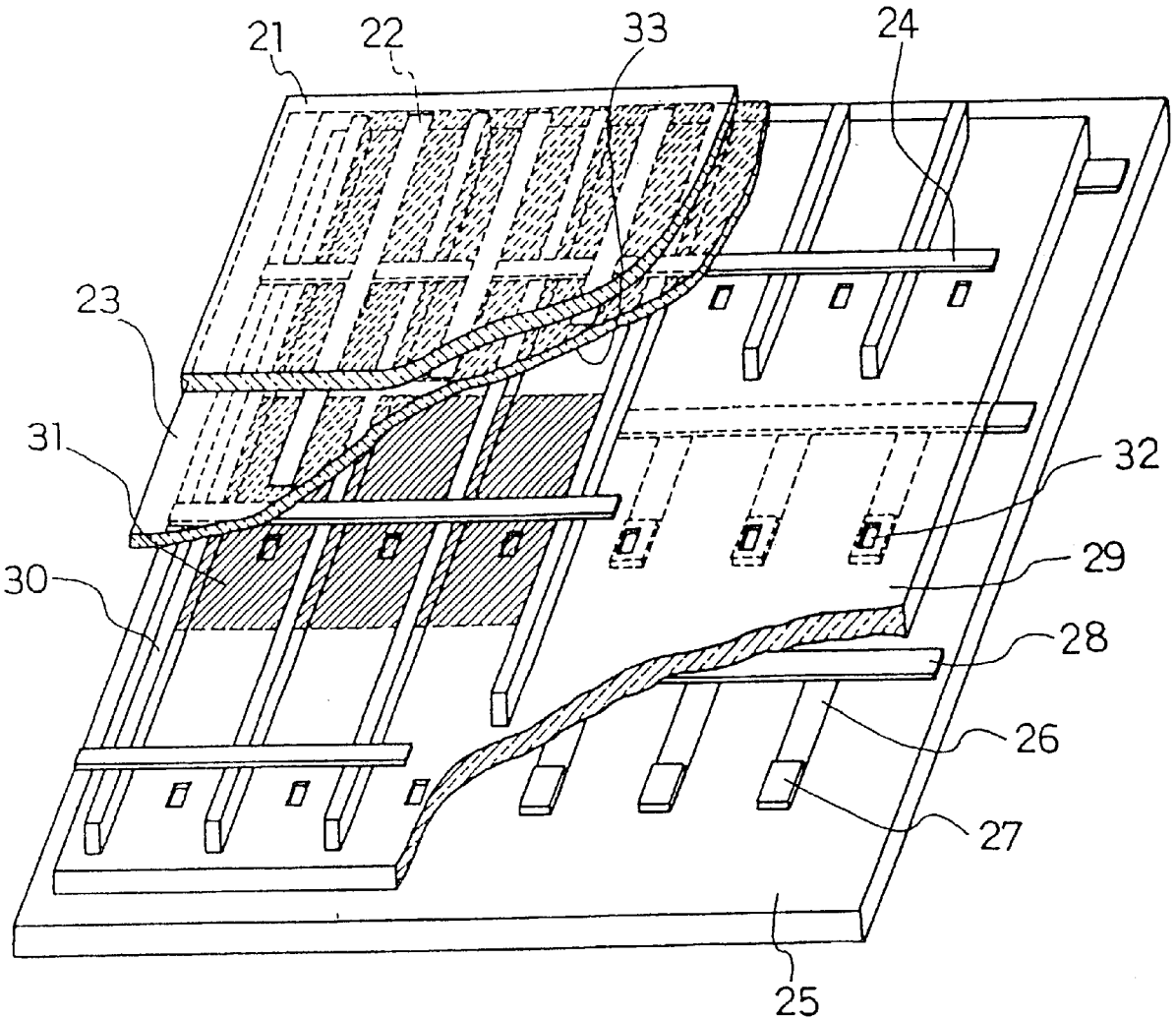
FIG. 7 is a perspective view showing a plasma display device in a fifth embodiment of the present invention.

FIG. 7 is a perspective view showing a plasma display device in a fifth embodiment.

The plasma display devices according to the first to fourth embodiments of the invention are different from the plasma display device of the fifth embodiment only in the configuration of the partition walls 30, and the other parts of the configuration remain unchanged.

According to this fifth embodiment, the partition walls 30 form as a whole a stripe shape, and each of them is arranged between two address electrodes adjacent to each other as shown in FIG. 7. Discharge cells 31 are formed in rows between the partition walls 30 adjacent to each other. This configuration of the partition walls 30 further simplifies the structure of the plasma display device.

First Embodiment of Driving Method

Next, a first embodiment of a method for driving the plasma display device will be described.

Figure 8:
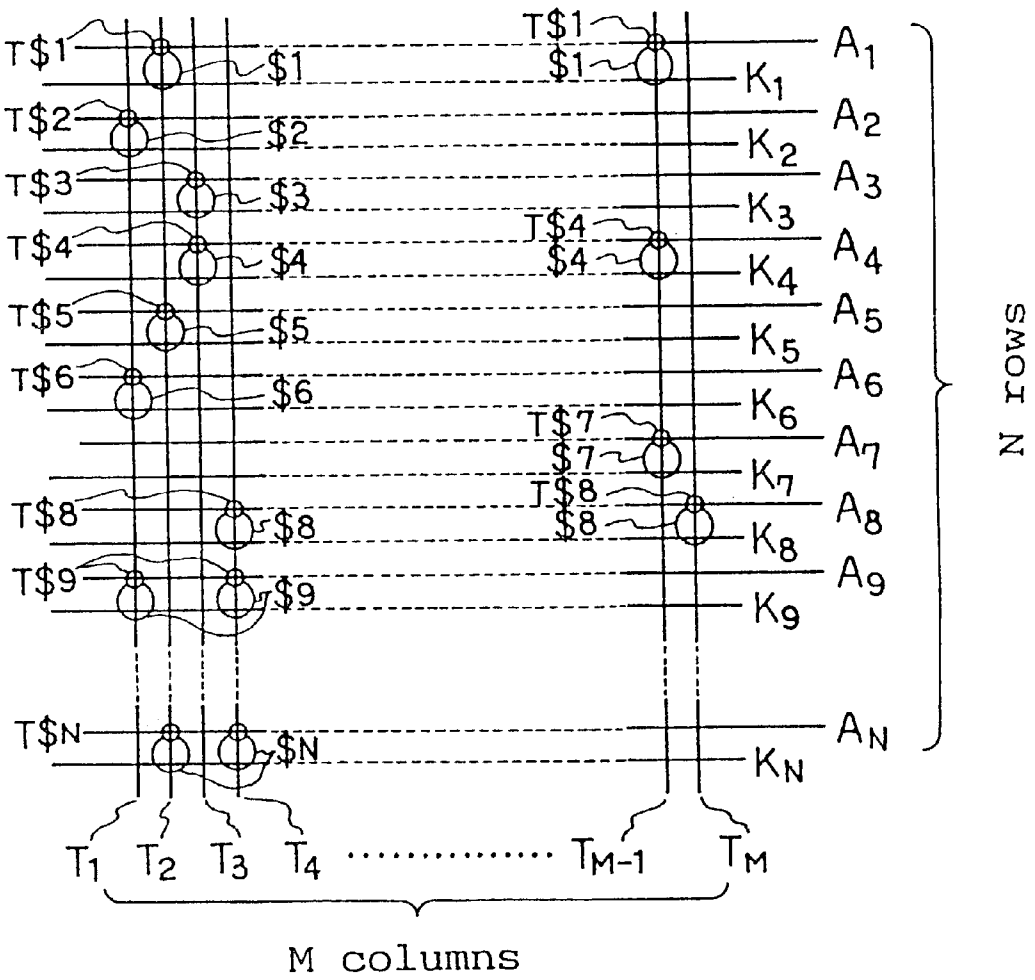
FIG. 8 is a matrix wiring diagram for the device in the first to fifth embodiments of the present invention.

The plasma display devices according to the first to fifth embodiments respectively shown in FIG. 1, FIG. 2, FIG. 3, FIG. 4 and FIG. 7 have an electrode configuration arranged in matrix as shown in FIG. 8. In a direction of row, there are provided N rows of anodes (24) $A_1$, to $A_M$ and N rows of cathode buses (28) $K_1$ to $K_N$. In a direction of column, there are provided M columns of address electrodes 22 $T_1$, to $T_M$.

Figure 9:
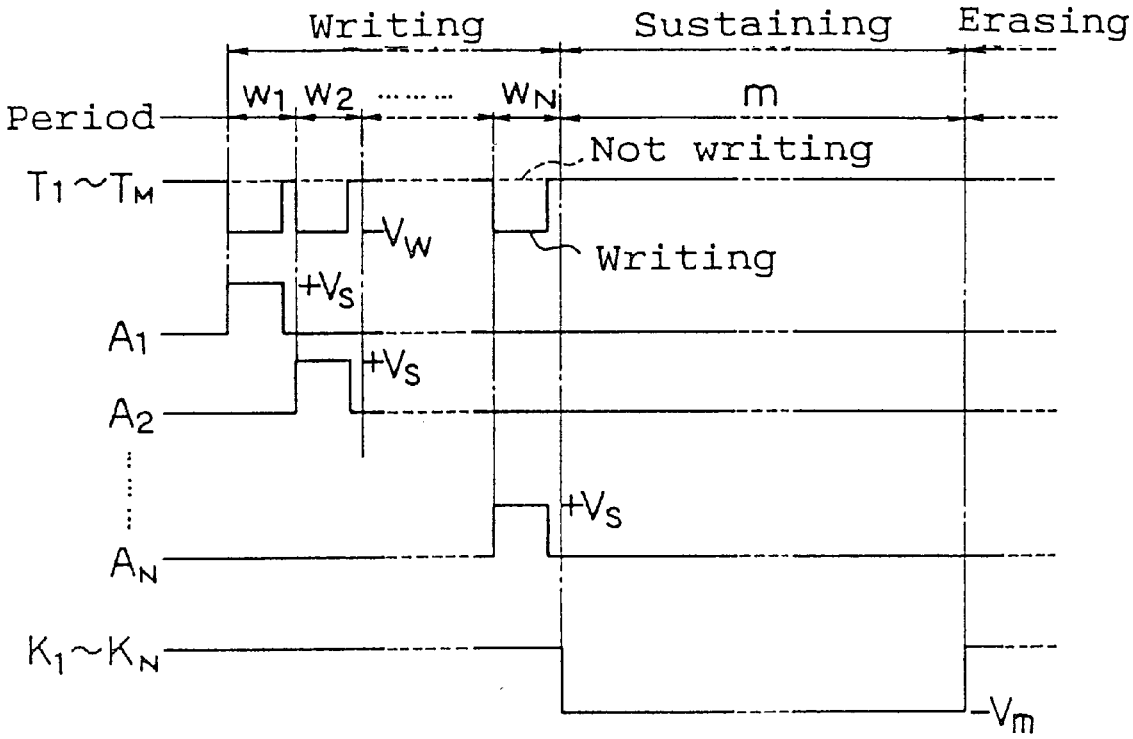
FIG. 9 is a timing chart of the driving voltage in a first embodiment of driving method for a plasma display device in the present invention.

FIG. 9 is a time chart showing voltage pulses applied to respective electrodes. Operation of displaying motion pictures such as TV picture will be hereafter described with reference to FIG. 8 and FIG. 9.

First, during the writing period $w_1$, a scanning pulse voltage $+V_s$ [V] is applied to the anode $A_1$ in the first scanning cycle, while at the same time applying a writing pulse voltage $-V_w$ [V] to certain ones of the address electrodes $T_1$ to $T_M$ which correspond to the discharge cells $1 (FIG. 8) to be lit for display. Then, a writing discharge occurs at each of some writing positions T$1, and a positive charge is accumulated in the face of the dielectric layer 23 (FIG. 1, etc.) around the anode in the vicinity of T$1 or in the face of the phosphor layer 33 provided on the face of the dielectric layer 23. The writing discharge automatically stops, and a display content for the first line is stored in the particular faces in the form of electric charge. The illumination of the writing discharge is very small as compared with the display illumination.

During the next writing period $w_2$, the scanning pulse voltage $+V_s$ [V] is applied to the anode A2 in the second scanning cycle, while at the same time applying a writing pulse voltage $-V_w$ [V] to certain ones of the address electrodes $T_1$ to $T_M$ which correspond to the discharge cells $2 to be lit for display. Then, a writing discharge occurs at each of writing positions T$2, and a positive charge is accumulated in the face of the dielectric layer 23 around the anode in the vicinity of T$2 or in the face of the phosphor layer 33 provided on the face of the dielectric layer 23. The writing discharge automatically stops, a display content for the second line is stored in the particular faces in the form of electric charge. The illumination of the writing discharge is very small as compared with the display illumination.

Similar operation is repeated in the subsequent scanning cycles. In the last writing period $w_N$ wherein a writing discharge occurs at each of the writing positions T$N, positive charge is accumulated in the face of the dielectric layer 23 or in the face of the phosphor layer 33 on the face of the dielectric layer 23 around the anode in the vicinity of the writing position T$N, so that the display content on the Nth line is stored in the particular faces in the form of electric charge.

Contents of display on a screen are thus stored in the faces of the dielectric layer 23 or in the face of the phosphor layer 33 provided on the face of the dielectric layer 23. Surface potentials of the dielectric layer 23 or the surface potentials of the phosphor layer 33 on the face of the dielectric layer 23 around the anode in the vicinity of the writing positions T$1 to T$N are maintained at a high positive voltage level.

Next, a DC negative sustaining voltage of $-V_m$ [V] is applied to all the cathode buses $K_1$ to $K_N$, and a voltage of 0 V is applied to all the anodes $A_1$ to $A_N$ during a sustaining period m. Then, all the anodes $A_1$, to $A_N$ have a high positive potential difference with respect to all the cathode buses $K_1$ to $K_N$. Also, the face of the dielectric layer 23 or the phosphor layer 33 on the face of the dielectric layer 23 where positive charge is accumulated has an even higher positive potential difference with respect to all the cathode buses $K_1$ to $K_N$. As a consequence, the positive charge accumulated in the face of the dielectric layer 23 or in the face of the phosphor layer 33 on the face of the dielectric layer 23 first triggers auxiliary discharge toward the cathodes 27 in opposed position. This auxiliary discharge induces a discharge current flow from the anodes of the display discharge cells $1 - - - $N to the cathode buses 28 through the cathodes 27 and the resistors 26. In this way, a sustained discharge is caused as the main discharge, and a field of image is displayed. When application of voltage to all the cathode buses $K_1$ - - - $K_N$ is stopped, the sustained discharge ceases. A similar operation is repeated sequentially from the second fields and on, thus displaying a dynamic image.

As obvious from the foregoing description, according to this embodiment, the writing operation and the sustaining operation can be performed independently of each other, and the sustained discharge is caused by application of a DC voltage.

Now, explanation will be made about grayscale display of a TV image using this embodiment as an example of taking advantage of the above-mentioned feature effectively.

Figure 10:
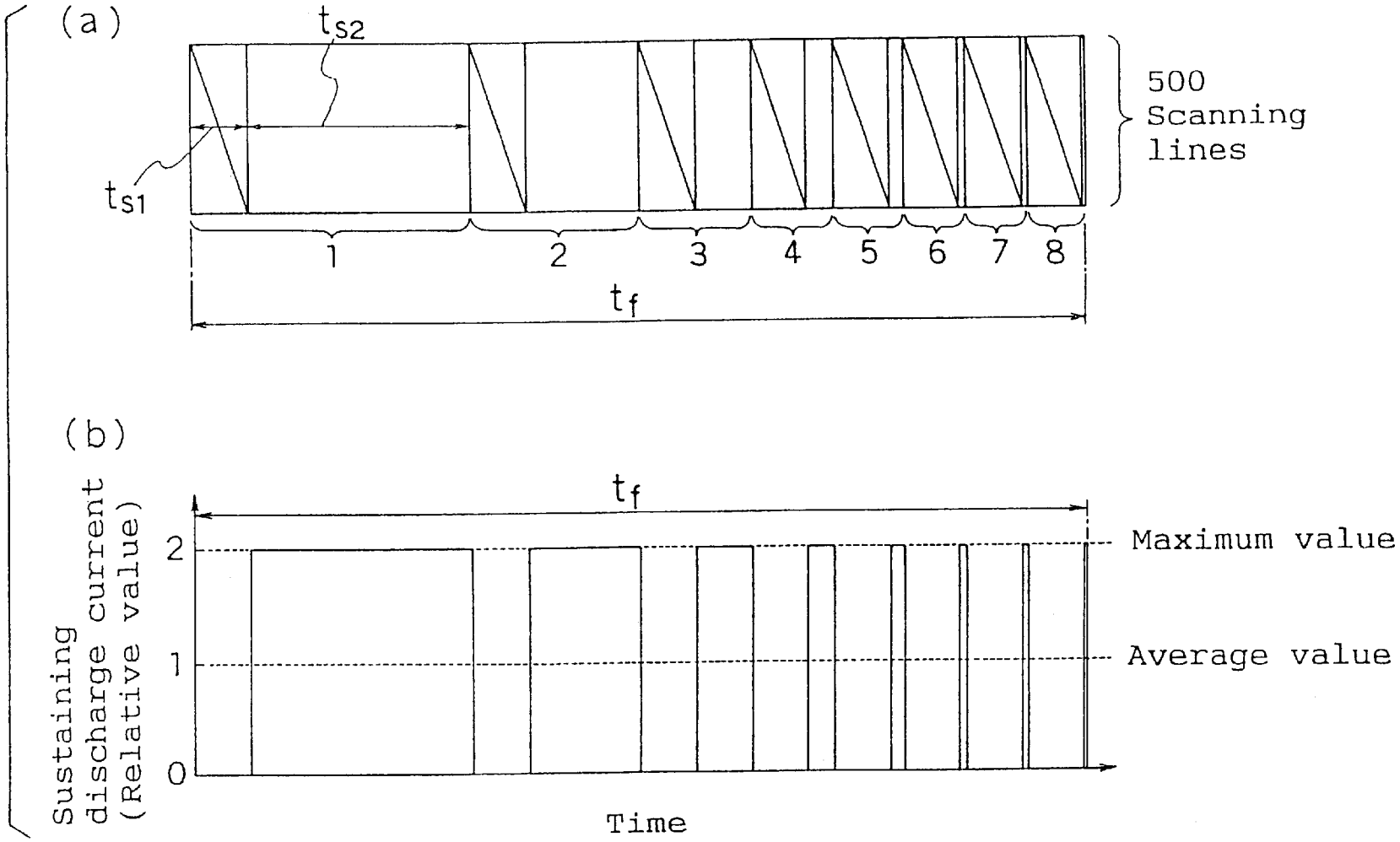
FIG. 10 is an operating diagram for the case in which the grayscale image is displayed in the first embodiment of the driving method.

FIG. 10 is a diagram showing an operation example for grayscale display of a TV image. In this example, the image display involves 500 TV lines, 256 gradations and a field period $t_f$ of 1/60 second. Each field has temporally-divided eight subfields, for each of which the writing and sustaining operations are sequentially performed. For example, in the first subfield, a writing period and a sustaining period are $t_{s1}$ and $t_{s2}$, respectively.

In this device, the maximum values of luminance, power consumption and discharge current were determined. Assuming that a writing time of one scanning cycle is 2 μsec meeting a minimum requirement for discharge, a writing time for the eight subfields is given as 8 msec (=2 μseconds× 500 TV lines×8 subfields). The maximum time Σm made available for sustained discharge is about 8 msec (=1/60 sec–8 msec). This maximum time Σm represents the length of 8 msec divided by 1/60 seconds, i.e., about ½ of the field period.

As has been described in the related art statement, the maximum time Σm made available for sustained discharge is conventionally 765 μseconds, which is about 1/20 of the field period. The plasma display device according to the present invention, on the other hand, a sustained discharge period up to ten times as long as that obtained conventionally is obtainable. An effective power for sustained discharge is obtained from a product of discharge current and discharge time. Therefore, the power equivalent to the prior art can be obtained by a discharge current of only 1/10 of the conventional current.

The experiment result shown in FIG. 6 indicates that the reduction of the discharge current Id to 1/5 (relative value= 0.2) increases the illumination efficiency η by a factor of 2.5 (relative value=2.5). Therefore, when the discharge current Id is reduced to 1/5 with the discharge time increased by five times, the luminance can be increased by a factor of 2.5 with the same amount of power consumption due to the discharge.

Also, with regard to the capacitive load based on the inter-electrode capacitance and the like of the plasma display device, a reactive power loss caused by the reactive current due to the sustaining pulse voltage is reduced to about $$1/100\ (=8[\text{times/subfield}]\div((128+64+32+16+8+4+2+1)\times 3[\text{N: times}])).$$

As a result, according to the present invention, an image display of 256 gradations is made possible with a small power consumption and a high luminance.

Further, investigation will be made about change of the sustained discharge current within one-field period. As shown in graph (a) of FIG. 10, the subfield arrangement according to the present invention makes it possible to handle both the writing operation and sustaining operation independent of each other, and therefore, the wasteful time such as a suspension period is substantially eliminated from each field period. Consequently, the writing periods and the sustaining periods can be packed to each other, so that a comparatively long sustained discharge period is available. As described above, the maximum time Σm made available for the sustained discharge is about one half of one field period, and therefore the maximum value of the sustained charge current is about double the average value thereof as shown in graph (b) of FIG. 10.

As has been described in the related art statement, the current capacity of a power supply for supplying the sustained discharge current is conventionally required to afford an amount about four times as large as the required average current. According to the present invention, a current capacity of the power supply for supplying the sustained discharge voltage can be reduced about by one half.

Second Embodiment of Driving Method

Now, explanation will be made about a method of driving a plasma display device in a second embodiment.

Figure 11:
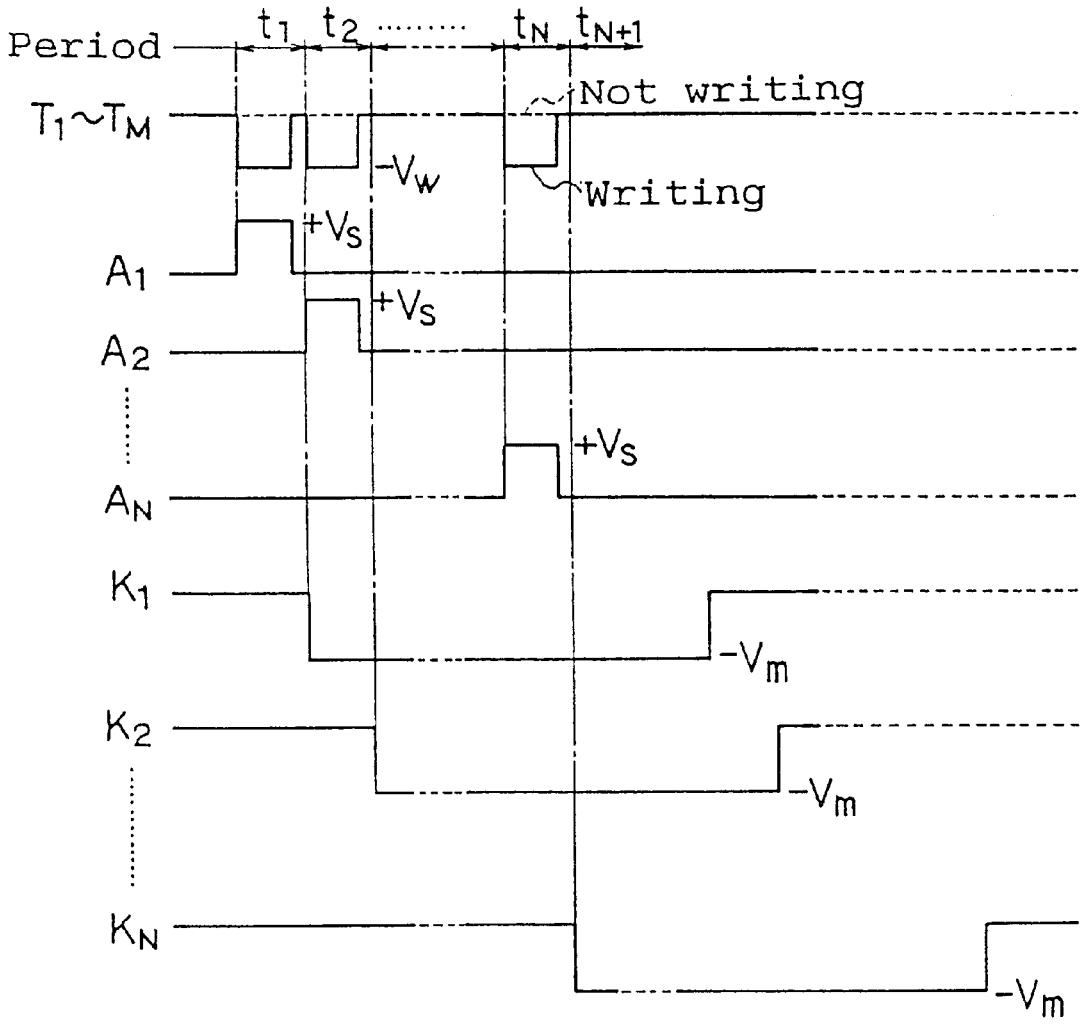
FIG. 11 is a timing chart of the driving voltage in a second embodiment of driving method for a plasma display device in the present invention.

FIG. 11 is a timing chart showing voltage pulses applied to respective electrodes. With reference to this diagram and FIG. 8, operation will be explained about the case where a dynamic image such as TV image is displayed.

During the period $t_1$, a scanning pulse voltage $+V_s$ [V] is applied to the anode $A_1$, and at the same time a writing pulse voltage $-V_w$ [V] is applied to certain ones o the address electrodes $T_1$ to $T_M$ which correspond to the discharge cells $1 (FIG. 8) to be lit for display. As a result, a writing discharge occurs at each of the writing positions T$1, and positive charge is accumulated in the face of the dielectric layer 23 around the anode in the vicinity of T$1 or in the face of the phosphor layer 33 provided on the face of the dielectric layer 23. The writing discharge automatically stops, and a display content for the first line is stored in the particular faces in the form of electric charge. The illumination of the writing discharge is very small as compared with the display illumination. In the process, the surface potential of the dielectric layer 23 or the surface potential in the face of the phosphor layer 33 (which is on the face of the dielectric layer 23 around the anode in the vicinity of the writing position T$1) is maintained at a high positive voltage level.

Next, a DC negative sustaining voltage $-V_m$ [V] is applied to the cathode buses $K_1$ during the period $t_2$, and also 0 [V] to the anode $A_1$. As a consequence, the anode $A_1$ assume a high positive voltage with respect to the cathode buses $K_1$. Also, the face of the dielectric layer 23 or the face of the phosphor layer 33 (on the face of the dielectric layer 23) where positive charge is accumulated has an even higher positive potential difference. In the first place, therefore, the positive charge accumulated in the face of the dielectric layer 23 or the in the face of the phosphor layer 33 on the face of the dielectric layer 23 causes auxiliary discharge toward the cathodes 27 in opposed relation to the particular faces. This auxiliary discharge induces a discharge current flow in the cathode bus $K_1$ through the cathodes 27 and the resistor 26 from the anode $A_1$ of the display discharge cells $1 to cause a sustained discharge as the main discharge, thereby displaying a field of image for one scanning cycle. The sustained discharge is stopped by discontinuing the voltage application to the cathode bus $K_1$ after the lapse of a sustained discharge time required.

During the subsequent time period $t_2$, a scanning pulse voltage $+V_s$ [V] is applied to the anode $A_2$ in the second scanning cycle, and a writing pulse voltage $-V_w$ [V] is applied at the same time to certain ones of the address electrodes $T_1$ to $T_M$ which correspond to the discharge cells $2 to be lit for display, a writing discharge occurs at each of the writing positions T$2. As a result, positive charge is accumulated in the face of the dielectric layer 23 or in the face of the phosphor layer 33 on the face of the dielectric layer 23 around the anode in the vicinity of the positions T$2. The writing discharge is thus automatically stopped, while at the same time storing the display content for the second line in the face described above. The illumination of this writing discharge is very small as compared with the display illumination. In the process, the surface potential of the dielectric layer 23 or, as the case may be, the surface potential of the phosphor layer 33 on the face of the dielectric layer 23 around the anode in the vicinity of the writing position T$2 is kept at a high positive voltage.

During the subsequent time period $t_3$ (not shown), when a DC negative sustaining voltage $-V_m$ [V] is applied to the cathode bus $K_2$ and 0 [V] to the anode $A_2$, the anode $A_2$ has a high voltage with respect to the cathode bus $K_2$. Also, since the face of the dielectric layer 23 or the face of the phosphor layer 33 on the dielectric layer 23 where positive charge is accumulated have an even higher positive potential difference, the positive charge accumulated in them triggers an auxiliary discharge toward the cathodes 27 disposed opposite to each of the particular faces. This discharge is followed by the discharge current flow from the anode $A_2$ of the display discharge cells $2 through the cathodes 27 and the resistor 26 to the cathode bus $K_2$. Consequently, a sustained discharge occurs as the main discharge, and a field of image for the next scanning cycle is displayed. When the voltage application to the cathode $K_2$ is stopped after the lapse of a required sustained discharge time, the sustained discharge ceases.

This operation is repeated sequentially in the successive scanning cycles. Finally, a writing discharge occurs at each of the writing positions T$N during the period $t_N$. Positive charge is thus accumulated in the face of the dielectric layer 23 or in the face of the phosphor layer 33 on the face of the dielectric layer 23 around the anode in the vicinity of the position T$N. In the subsequent time period $t_{N+1}$, the DC negative sustaining voltage $-V_m$ [V] is applied to the cathode bus $K_N$ and a voltage of 0 [V] to the anode $A_N$. Therefore, the positive charge accumulated in the face of the dielectric layer 23 or in the face of the phosphor layer 33 triggers an auxiliary discharge toward the cathodes 27 disposed opposite to each of the particular faces. This induces a sustained discharge as the main discharge with a discharge current flowing from the anode $A_N$ of the discharge cells $N through the cathodes 27 and the resistor 26 to the cathode bus $K_N$, so that a field of image for the last scanning cycle is displayed. When the voltage application to the cathodes $K_N$ is stopped after the lapse of a required sustained discharge time, the sustained discharge is stopped. As a consequence, a field of image is displayed for the entire scanning process.

A similar operation is repeated sequentially for the second and subsequent fields, thereby making it possible to display a dynamic image.

As is obvious from the foregoing description, the feature of the present embodiment resides in that the writing operation and the sustaining operation can be performed independently of each other for each scanning cycle and that the sustained discharge is accomplished by applying a DC voltage.

Apart from the foregoing embodiment in which the writing operation in the first scanning cycle is performed during the period $t_1$ and the writing operation in the second scanning cycle during the period $t_2$, followed by similar continuous scanning sequences to repeat the same operation, another method may be such that the second scanning cycle following the first one is executed during a time period other than the period $t_2$.

Next, the grayscale display of TV image according to this embodiment will be described as an example effectively utilizing the above-mentioned feature.

Figure 12:
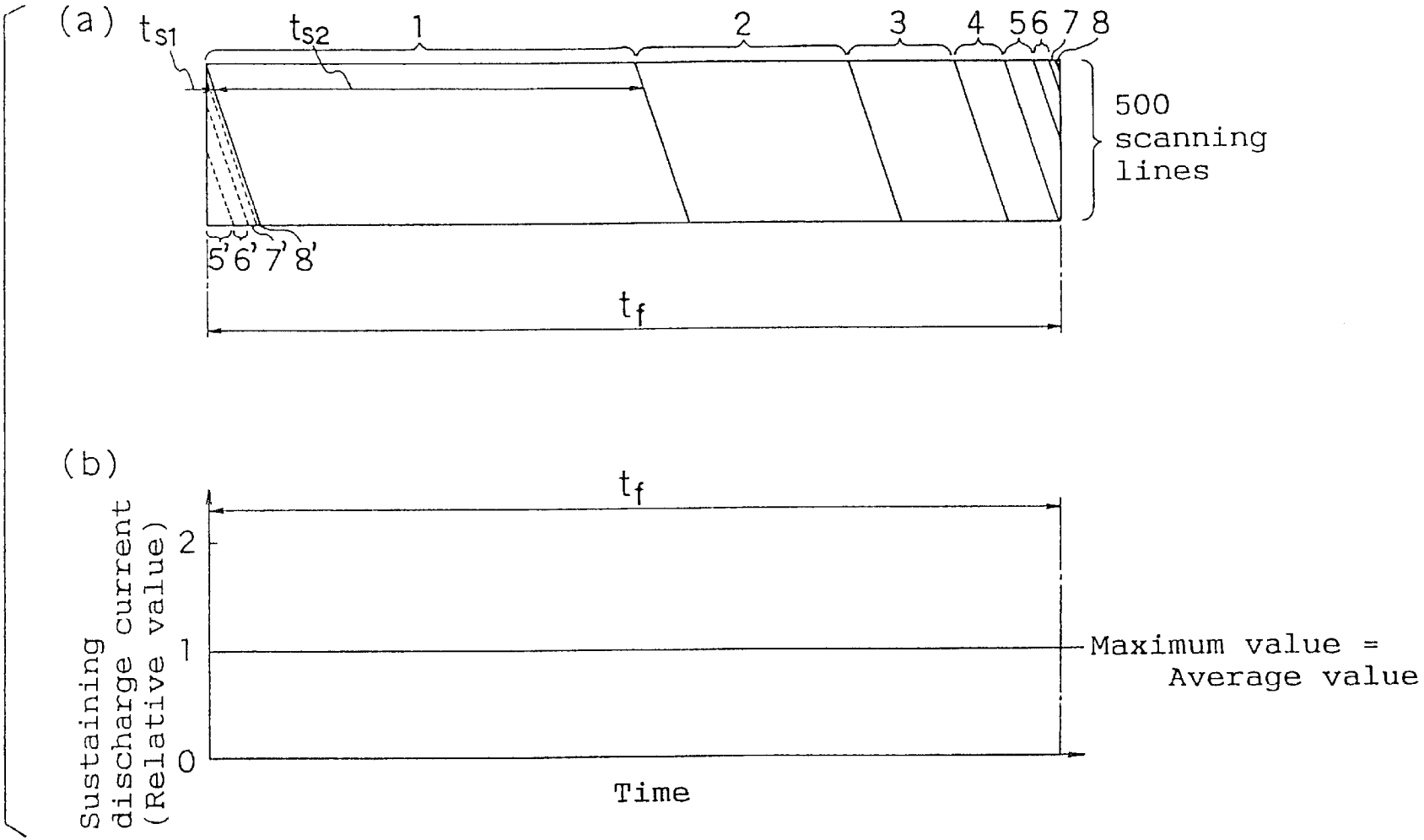
FIG. 12 is an operating diagram for the case in which the grayscale image is displayed in the second embodiment of the driving method.

FIG. 12 is a diagram showing an operation example for grayscale display of a TV image, in which an image display involves 500 TV lines, 256 gradations and a field period $t_f$ of 1/60 second. Each field consists of eight temporally-divided subfields, so that the writing operation and the sustaining operation are performed sequentially for each subfield. Each subfield consists of a writing period and a sustaining period which are, for example, $t_{s1}$ and $t_{s2}$, respectively.

In the device driven by this method, the maximum values of luminance, power consumption and discharge current were determined.

Assuming that the writing time for each scanning cycle is the minimum time of 2 μsec required for discharge, the writing time for eight subfields is given as 2 μseconds×8 subfields (=16 μseconds). The maximum time Σm made available for the sustained discharge is 1/60 second−16 μseconds, i.e., about 16 msec. Thus, a ratio of the maximum time Σm to the field period is given as 16 msec÷1/60 second which is approximately equal to 1.

Figure 22:
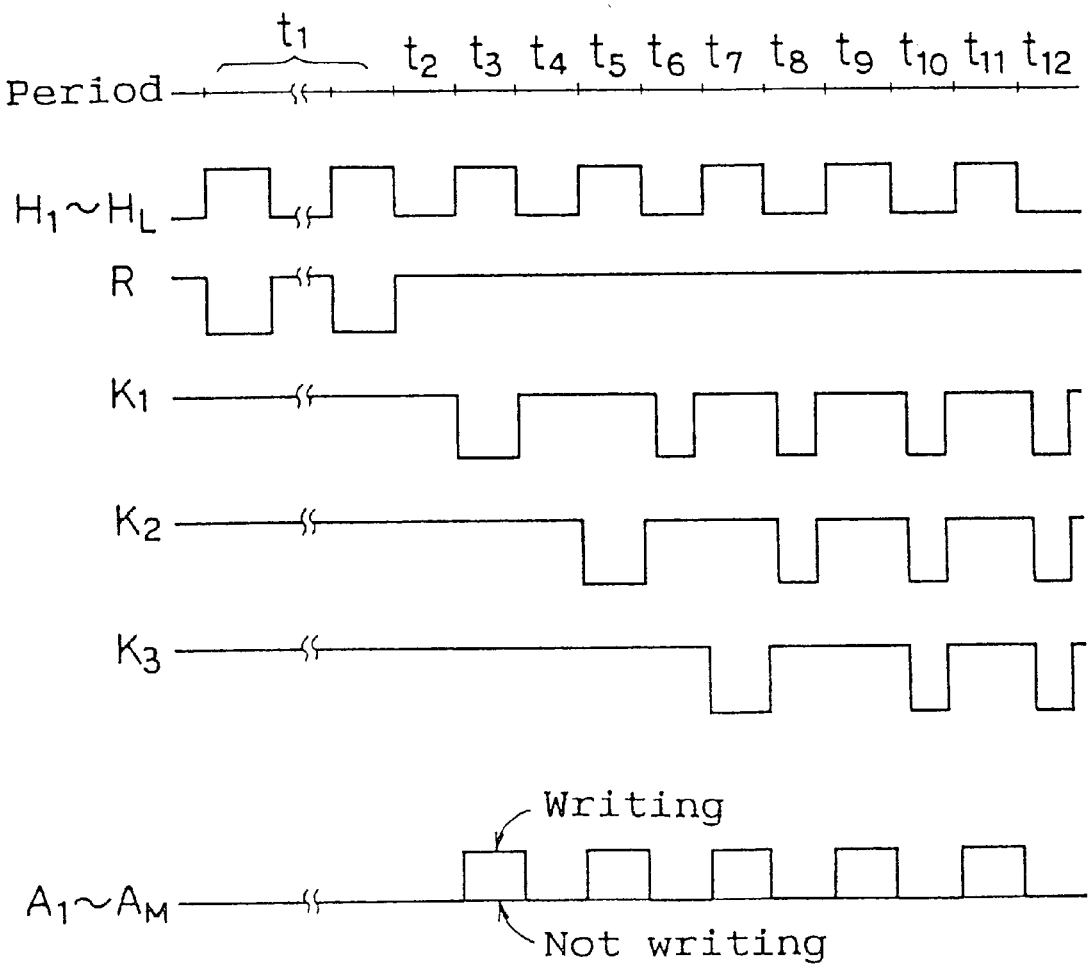
FIG. 22 (Prior Art)
FIG. 22 is a timing chart of the driving voltage for the case in which an image is displayed by the conventional plasma display device.
Figure 23:
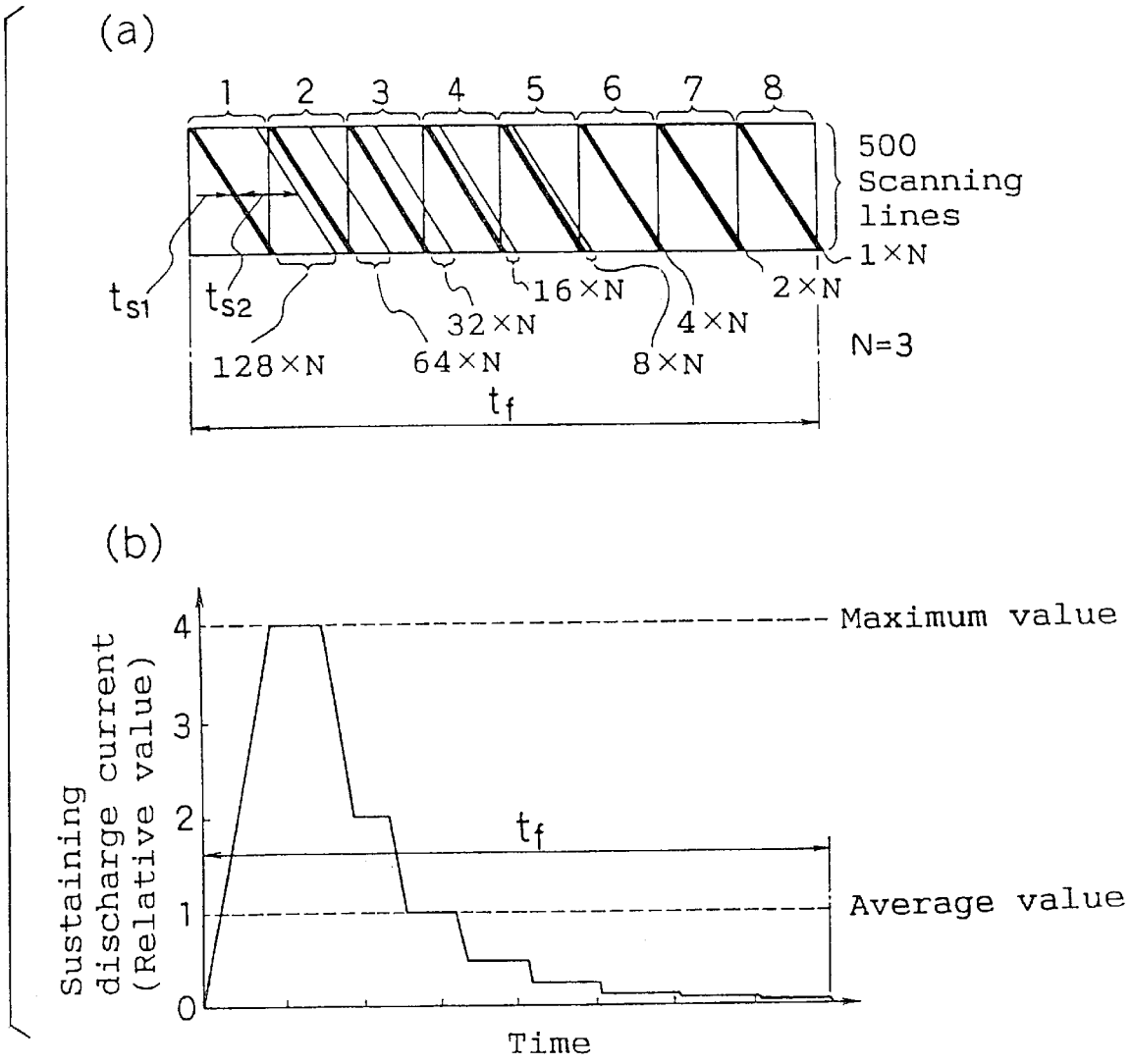
FIG. 23 (Prior Art)
FIG. 23 is an operating diagram for the case in which the grayscale image is displayed by the conventional display device.

As is apparent from comparison of the above-mentioned results with the conventional method for driving the plasma display device shown in FIG. 22 and FIG. 23, the method of the present embodiment can secure a sustained discharge time up to 20 times as long as that the time required conventionally. This fact makes it possible to increase the luminance by a factor of 2.5 with the same power consumption for discharge when the discharge current Id is reduced to (1/5)Id and the discharge time increased by five times.

Also, with respect to the capacitive load based on the inter-electrode capacitance or the like of the plasma display device, the reactive power loss based on the reactive current caused by the sustaining pulse voltage is reduced to about 1/100 of the reactive power loss in the conventional art. According to the present embodiment, it is possible to perform image display of 256 gradations with a small power consumption and a high luminance.

Change of the sustained discharge current within one field period will be investigated. In the subfield arrangement by the present embodiment as shown in graph (a) of FIG. 12, the writing operation and the sustaining operation can be executed independent of each other within each scanning cycle. Therefore, there exists substantially no wasteful time such as a suspension time during the one-field period for each scanning cycle. As a result, the writing periods and the sustaining periods can be closely packed to each other, and a sufficiently long sustained discharge time can be secured. As aforementioned, since the ratio of the maximum time Σm made available for the sustained discharge with respect to one field period is about 1, the maximum value of the sustained discharge current is substantially equal to the average value thereof as shown in graph (b) of FIG. 12. Consequently, according to this embodiment, the current capacity of the power supply for supplying a sustained discharge current is 1/4 of the current capacity required for the conventional art. Therefore, a power supply having a current capacity for only an average current can be used.

Third Embodiment of Driving Method

Next, a third embodiment of the driving method for a plasma display device will be described.

Figure 13:
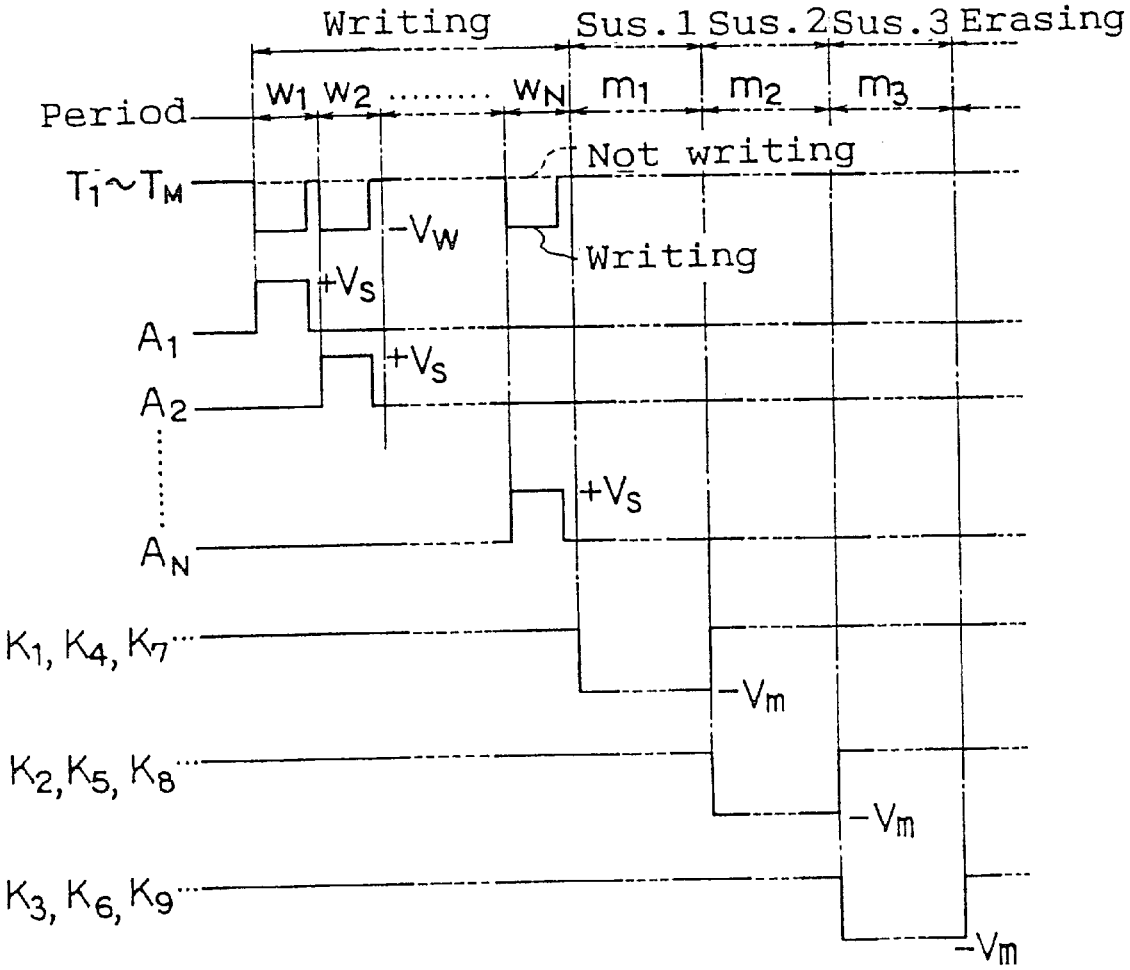
FIG. 13 is a timing chart of the driving voltage in a third embodiment of driving method for a plasma display device in the present invention.

This embodiment is different from the second embodiment of the driving method only in the operation timing of the driving voltage. FIG. 13 is an operation timing chart of the driving voltage. The display operation for a dynamic image such as TV image will be explained below with reference to FIG. 1, FIG. 2, FIG. 3, FIG. 4, FIG. 7 and FIG. 8.

First, during the writing period $w_1$, a scanning pulse voltage $+V_s$ [V] is applied to the anode $A_1$ in the first scanning cycle, while at the same time applying a writing pulse voltage of $-V_w$ [V] to certain ones of the address electrodes $T_1$ to $T_M$ which correspond to the discharge cells $1 to be lit for display. This triggers the writing discharge at each of the writing positions T$1, so that positive charge is accumulated in the face of the dielectric layer 23 or in the face of the phosphor layer 33 on the face of the dielectric layer 23 around the anode in the vicinity of the same position T$1. The writing discharge is thus automatically stopped, and the content of display for the first line is stored in the above-mentioned faces. The illumination due to this writing discharge is very small as compared with the display illumination.

During the subsequent writing period $w_2$, a scanning pulse voltage $+V_s$ [V] is applied to the anode $A_2$ in the second scanning cycle, while at the same time applying a writing pulse voltage $-V_w$ [V] to certain ones of the address electrodes $T_1$ to $T_M$ which correspond to the discharge cells $2 to be lit for display. Then, a writing discharge occurs at each of the positions T$2, so that positive charge is accumulated in the face of the dielectric layer 23 or in the face of the phosphor layer 33 on the face of the dielectric layer 23 around the anode in the vicinity of the same position T$2. The writing discharge is thus automatically stopped, and at the same time the display content for the second line is stored in the above-mentioned faces. The illumination of the writing discharge is very small as compared with the display illumination.

This operation is followed by the repeated sequential scanning processes in continuous fashion. Finally, in the writing period $w_N$, a writing discharge occurs at each of the writing positions T$N. As a result, a positive charge is stored in the face of the dielectric layer 23 or in the face of the phosphor layer 33 on the face of the dielectric layer 23 around the anode in the vicinity of the same position T$N. Consequently, the display content for one field is stored in the particular faces of the dielectric layer 23. In the process, a high positive surface potential is maintained in the face of the dielectric layer 23 or in the face of the phosphor layer 33 on the face of the dielectric layer 33 around the anode in the vicinity of the writing positions T$1 to T$N.

Next, during the sustaining period $m_1$, as shown in FIG. 8, a DC negative sustaining voltage $-V_m$ [V] is applied to the cathode buses $K_1$, $K_4$, $K_7$, . . . which constitute a subgroup 1, and similarly 0 [V] voltage to all the anodes $A_1$ to $A_N$. The anodes $A_1$ to $A_N$ have a high positive voltage with respect to the subgroup 1. Also, the face of the dielectric layer 23 or the face of the phosphor layer 33 on the face of the dielectric layer 23 where positive charge is stored has an even higher positive voltage as compared with all the cathode buses $K_1$ to $K_N$. Therefore, the positive charge stored in the face of the dielectric layer 23 or the face of the phosphor layer 33 on the face of the dielectric layer 23 causes an auxiliary discharge toward a plurality of cathodes of the cathode buses $K_1$, $K_4$, $K_7$, . . . of the opposed subgroup. This auxiliary discharge induces a discharge current flowing from the anodes of the display discharge cells $1, $4, $7, . . . which correspond to the subgroup 1 through the cathode 27 and the resistor 26 to the cathode bus 28. As a result, a sustained discharge occurs as the main discharge, and a field of image is displayed for the display discharge cells $1, $4, $7, . . . corresponding to the subgroup 1. The sustained discharge ceases when the voltage application to the cathode buses $K_1$, $K_4$, $K_7$, . . . corresponding to the subgroup 1 is stopped.

Next, a DC negative sustaining voltage $-V_m$ [V] is applied to the cathode buses $K_2$, $K_5$, $K_8$, . . . which constitute a subgroup 2 during the sustaining period $m_2$, and at the same time a voltage of 0 [V] to all the anodes $A_1$ to $A_N$. Then, the anodes $A_1$ to $A_N$ have a high positive voltage with respect to the subgroup 2. Also, the face of the dielectric layer 23 or the face of the phosphor layer 33 on the face of the dielectric layer 23, in which positive charge is stored, have a positive voltage higher than the voltage appearing in the anodes. As a result, the positive charge stored in the face of the dielectric layer 23 or in the face of the phosphor layer 33 on the face of the dielectric layer 23 triggers an auxiliary discharge toward a plurality of cathodes 27 of the cathode buses $K_2$, $K_5$, $K_8$, . . . of the subgroup 2. This auxiliary discharge induces a discharge current flowing to the cathode bus 28 from the anodes of the display discharge cells $2, $5, $8, . . . which correspond to the subgroup 2 through the cathode 27 and the resistor 26. Thus, a sustained discharge occurs as a main discharge, so that a field of image is displayed with respect to the display discharge cells $2, $5, $8, . . . which correspond to the subgroup 2. Then, the sustained discharge is stopped by discontinuing the voltage application to the cathode buses $K_2$, $K_5$, $K_8$, . . . of the subgroup 2.

During the subsequent sustaining time period $m_3$, a DC cathode sustaining voltage $-V_m$ [V] is applied to the cathode buses $K_3$, $K_6$, $K_9$, . . . which constitute a subgroup 3 and at the same time a voltage of 0 [V] to all the anodes $A_1$ to $A_N$. The anodes $A_1$ to $A_N$ have a high positive voltage with respect to the subgroup 3. Also, the face of the dielectric layer 23 or the face of the phosphor layer 33 on the face of the dielectric layer 23, in which the positive charge is stored, has an even higher positive potential difference with respect to all the cathode buses $K_1$ to $K_N$. The positive charge stored in the face of the dielectric layer 23 or in the face of the phosphor layer 33 on the face of the dielectric layer 23 triggers an auxiliary discharge toward the cathodes 27, which are disposed opposite to the faces, of a plurality of cathode buses $K_3$, $K_6$, $K_9$, . . . of the subgroup 3. This auxiliary discharge induces a discharge current flowing to the cathode bus 28 from the anodes of the display discharge cells $3, $6, $9, . . . corresponding to the subgroup 3 through the cathode 27 and the resistor 26. In this way, a sustained discharge occurs as a main discharge, so that a field of image is displayed with respect to the display discharge cells $3, $6, $9, . . . which correspond to the subgroup 3. When the voltage application to the cathode buses $K_3$, $K_6$, $K_9$, . . . of the subgroup 3 is stopped, the sustained discharge also stops.

Similar operation is repeated sequentially for the second and subsequent fields thereby to display a dynamic picture.

Apart from the above-mentioned embodiment in which the cathode buses are divided into three groups of subgroups 1, 2 and 3, a similar operation is applicable also when the cathode buses are divided into subgroups in a manner different from that.

As is obvious from the foregoing description, according to this embodiment, the writing operation and the sustaining operation can be performed independently of each other for each subgroup and therefore the sustained discharge is executed by applying a DC voltage.

Next, the grayscale display of a TV image according to this embodiment will be explained as an example effectively utilizing the above-mentioned feature.

Figure 14:
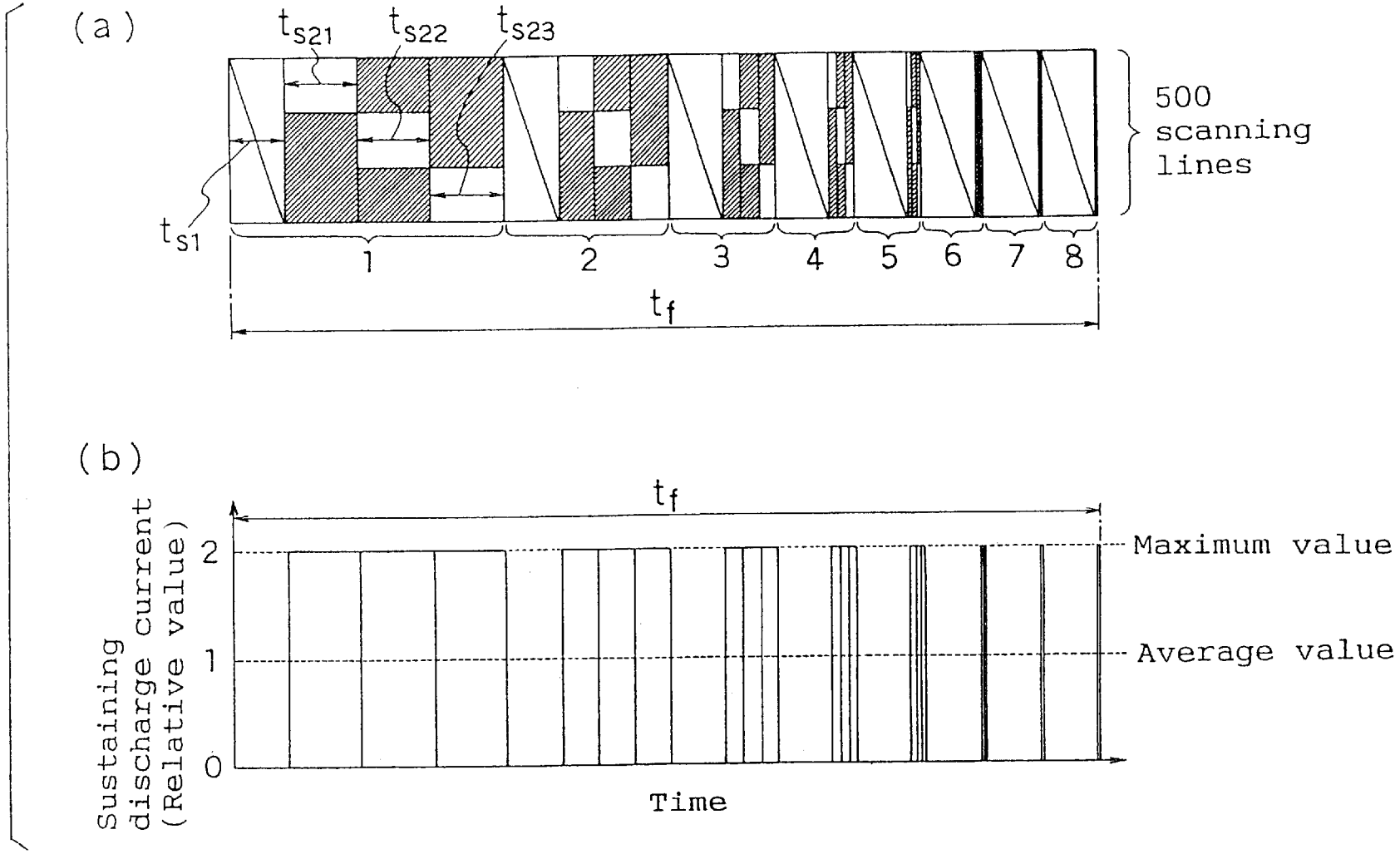
FIG. 14 is an operating diagram for the case in which the grayscale image is displayed in the third embodiment of the driving method.

FIG. 14 is a diagram showing an operation example for the grayscale display of TV image. The image display involves 500 TV lines, 256 gradations, and one field period $t_f$ of 1/60 second, and each field is temporally divided into eight subfields. The writing operation and three subgroups of the sustaining operation are performed sequentially for each subfield. For example, the first subfield consists of a writing period $t_{s1}$ and a sustaining period $t_{s21}$, $t_{s22}$ and $t_{s23}$. Hatched areas in the figure mean the remaining 2/3 subgroups in which the sustaining operation is not performed at the present time. That is, in the sustaining period $t_{s21}$, only one subgroup corresponding to particular cathodes k1, k4, k7, . . . are in the sustaining operation, and the remaining subgroups are not in the sustaining operation. In the subsequent sustaining period $t_{s22}$, another subgroup corresponding to particular cathodes k2, k5, k8, . . . are in the sustaining operation, and the remaining subgroups are not in the sustaining operation. Further, in the subsequent sustaining period $t_{s23}$, the other subgroup corresponding to particular cathodes k3, k6, k9, . . . are in the sustaining operation, and the remaining subgroups are not in the sustaining operation.

In this method, the maximum value of the luminance, power consumption and discharge current will be determined.

In FIG. 14, since the sustaining operation is divided into three subgroups, a rate of the maximum time Σm made available for the sustained discharge against one-field period is equal a value obtained by dividing the aforementioned rate (=½, obtained by the method shown in graph (a) of FIG. 10) by the number (=3) of subgroups. This value is ⅙ (=½×⅓). Since the value in the conventional art was 1/20, a sustained discharge period, which can be secured for each subgroup in the embodiment, is 10/3 (=(⅙)/(1/20)) times as long as the conventional value. This shows that the driving method according to this embodiment can secure the same power as in the conventional method with a discharge current reduced to 3/10. Also, as is obvious from FIG. 6, when the discharge period is increased to 10/3 while reducing the discharge current Id to 3/10, the luminance can be doubled without changing the power consumption for the discharge. Further, the reactive power loss due to the reactive current caused by the sustaining pulse voltage is about 1/100 as compared with the conventional method.

As a consequence, according to this embodiment, an image display of 256 gradations is possible with a reduced power consumption and a higher luminance.

Further, as described above, the maximum time Σm made available for the sustained discharge for each subgroup is ⅙ of the one-field period. Therefore, although the maximum value of the sustained discharge current is six times larger for each scanning cycle, the maximum value of the sustained discharge current for each subgroup is obtained by dividing the same value by the number of subgroups, i.e., 6/3 (=double) of the one-field period. The maximum value of the sustained discharge current is about double the average value as shown in graph (b) of FIG. 14, which is ½ of the conventional value (four times).

According to the present embodiment, therefore, the current capacity of the power supply for supplying the sustained discharge current can be reduced by one half.

Sixth Embodiment of the Device

Figure 15:
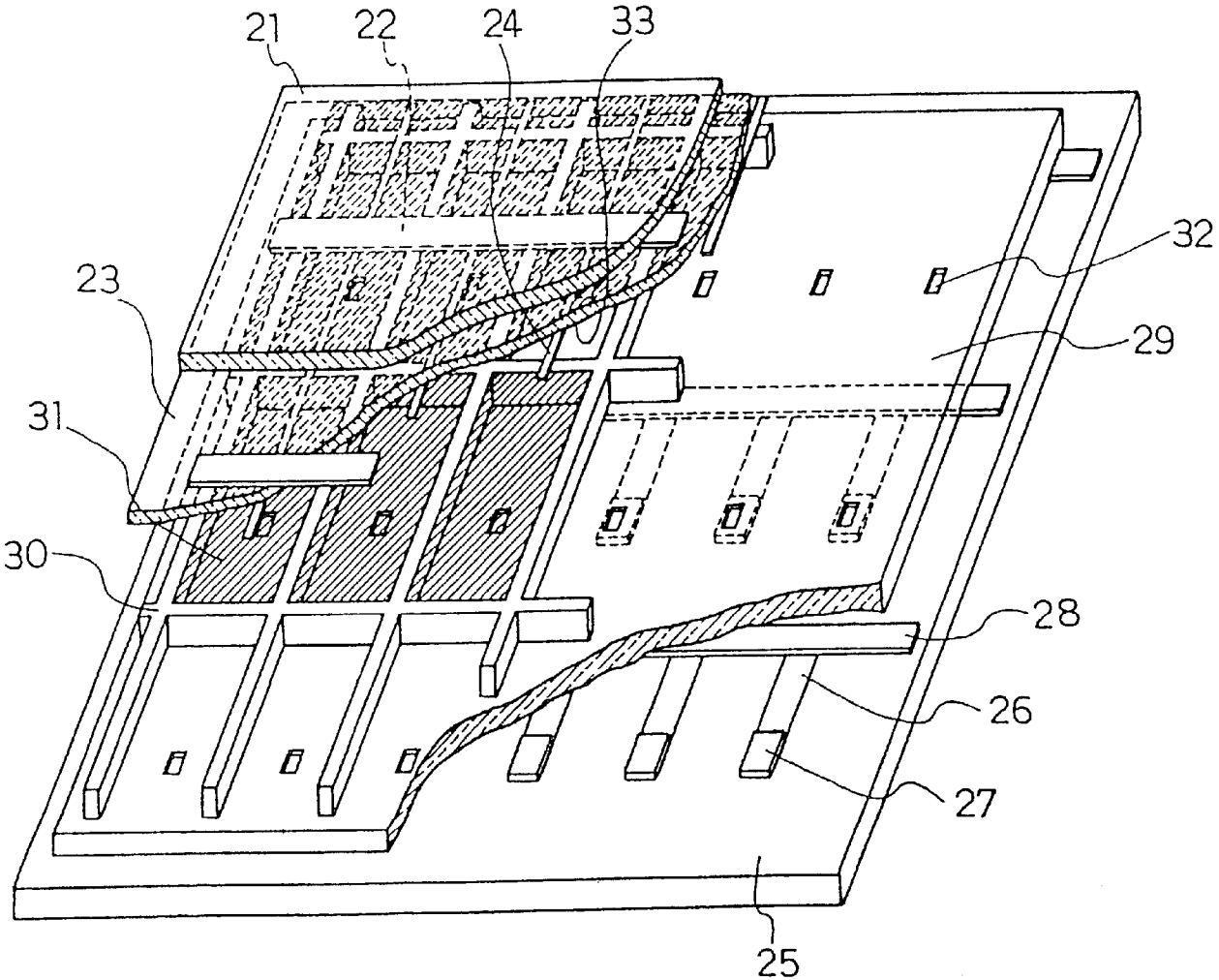
FIG. 15 is a perspective view of a plasma display deice in a sixth embodiment of the present invention.

FIG. 15 is a perspective view showing a plasma display device in a sixth embodiment. The plasma display device according to this embodiment, as shown in FIG. 15, comprises a plurality of address electrodes 22 arranged into stripe, a dielectric layer 23, and a plurality of anodes 24 arranged into stripe. These parts are disposed sequentially to form layers on an insulating substrate 21.

The anodes 24 are disposed perpendicular to the address electrodes 22. A plurality of cathode buses 28 including a plurality of resistors 26 and small-sized cathodes 27 are arranged on a transparent glass substrate 25. An insulating layer 29 is overlaid on this assembly. The cathode buses 28 are disposed perpendicular to the anodes 24 with the dielectric layer 23 and the insulating layer 29 therebetween. The cathodes 27 are located to face the address electrodes 22 and the anodes 24.

A plurality of small regions of discharge cells 31 are formed by partitioning each space defined by the anodes 24 and the cathodes 27 with a plurality of rectangular partition walls 30. The insulating layer 29 has a plurality of discharge holes 32 in positions where the anodes 24 and the cathodes 27 are faced each other, thereby to allow at least a part of each cathode 27 to expose to the space in the discharge cell 31. Also, the anodes 24 are arranged perpendicular to and opposite to the address electrodes 22 in such a manner that the charge is stored at least in the face of the dielectric layer 23 around the anodes 24. At least selected one of rare gases for discharge including helium, neon, argon, xenon and krypton is sealed in the discharge cells 31.

As is obvious from the foregoing description, the electrodes forms an arrangement of a plurality of rows and columns in two level crossing. More specifically, the address electrodes 22 are formed in a plurality of rows, and the anodes 24 in a plurality of columns. These two types of electrodes are arranged in the row-column relation which is reverse to the first embodiment (FIG. 1). The anodes 24 are arranged perpendicular to the address electrodes 22 in two level crossing. Also, the cathodes 27 are aligned in parallel to the address electrodes 22 for each assembly of rows connected to the same cathode bus 28, and the cathodes 22 straightly aligned in every row form an arrangement of a plurality of rows (i.e., linear alignment of the cathodes) as a whole.

To perform monochromatic display with this plasma display device, it is necessary to seal at least selected one of rare gases including neon, argon and the like in the discharge cells 31, thereby to display image with a color based on the discharge illumination color of these gases. Apart from this monochromatic display, it is required for multicolor display to form a phosphor layer 33 on the faces of the partition walls 30 and the dielectric layer 23 around the anodes 24 in the discharge cells 31. At least selected one of discharge rare gases including helium, neon, argon, xenon and krypton is sealed in the discharge cells 31. The phosphor layer 33 is excited by the ultraviolet rays emitted by the discharge of these gases, so that the display is effected with the illumination color generated from the phosphor layer 33.

Although the resistors 26 may be formed by thick-film printing with a metal or a metal oxide film as a material, a thin film is desirably formed by applying the electron beam, sputtering or CVD process to a transparent material such as ITO or $SnO_2$ in order to permit efficient transmission of the illumination color through the material employed.

In the case where a display device is designed as viewable from the insulating substrate 21 side, the insulating substrate 21 consists of a transparent glass, and the address electrodes 22 and the anodes 24 are formed with a thin film of a transparent material such as ITO or $SnO_2$.

The plasma display device according to this embodiment has a simple configuration due to absence of an auxiliary discharge cell as in the first embodiment. Also, the configuration of the parts on the insulating substrate 21 is simplified to the same extent as that on the glass substrate 25.

The configuration of the above-mentioned sixth embodiment of the device may be combined with the configuration of the fourth or fifth embodiment of the device.

Seventh Embodiment of the Device

Next, explanation will be made about a plasma display device in a seventh embodiment.

A difference between the plasma display device in this embodiment and that in the sixth embodiment lies only in the configuration of the component parts on the transparent glass substrate 25 while the configuration of the other component parts remains unchanged.

Also, the configuration of the component parts on the transparent glass substrate 25 in this embodiment is identical to that of the device shown in FIG. 4 in the fourth embodiment. Accordingly, the description of the fourth embodiment is applicable to this seventh embodiment.

According to this embodiment, the same operation and the same effects are obtained as the fourth embodiment.

Eighth Embodiment of the Device

Figure 16:
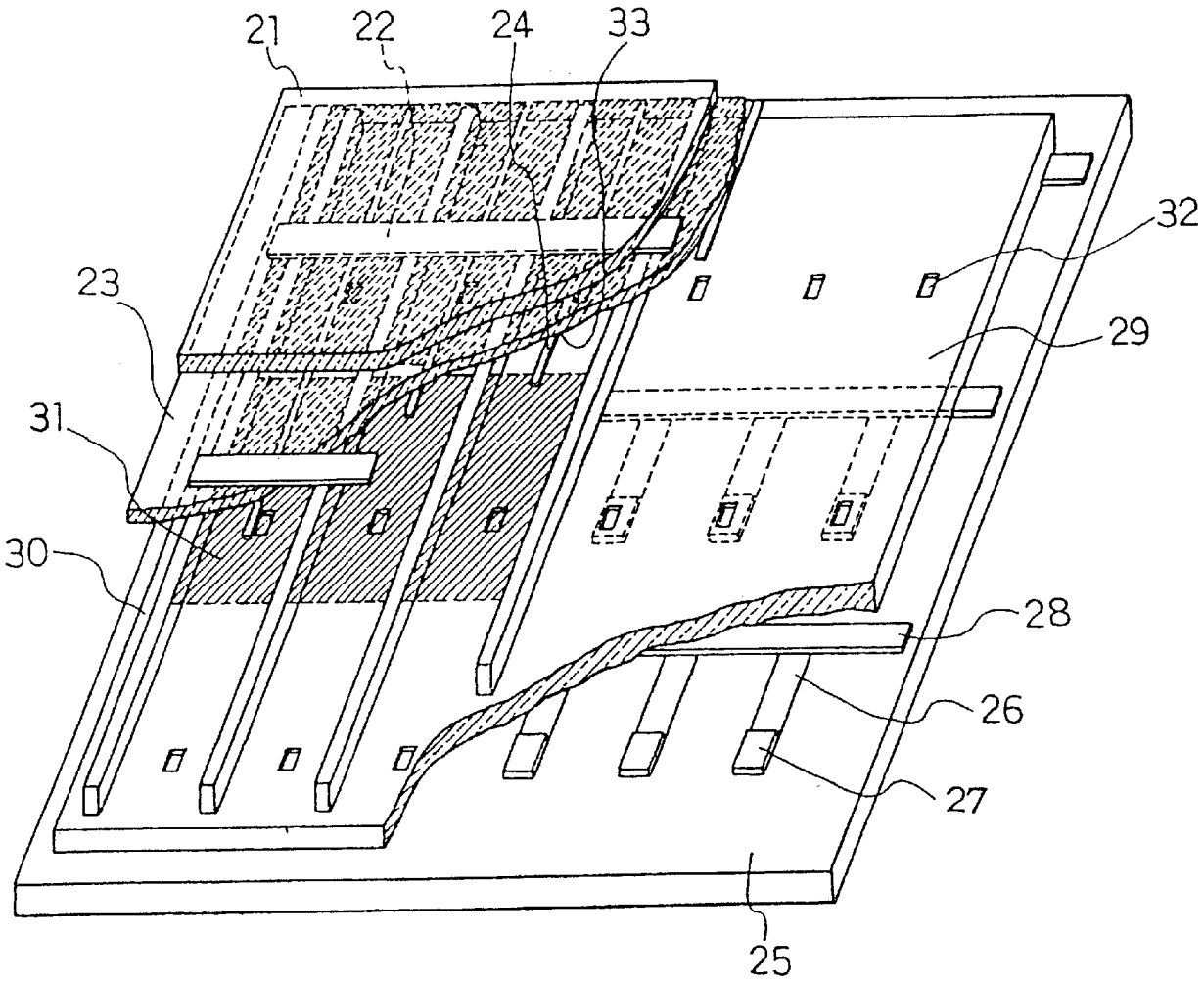
FIG. 16 is a perspective view of a plasma display device in an eighth embodiment of the present invention.

FIG. 16 is a perspective view showing a plasma display device in an eighth embodiment of the invention.

The plasma display device in this embodiment is different from that according to the sixth and seventh embodiments in the configuration of the partition walls, and the other component parts have the same configuration as the corresponding component parts of the sixth and seventh embodiments.

The configuration of the partition walls in this embodiment is such that, as shown in FIG. 16, a plurality of partition walls 30 are interposed between the anodes 24, and columns of discharge cells 31 are formed between the adjacent-two partition walls 30. This configuration of the partition walls further simplifies the device structure.

According to this embodiment, the same effect is obtained as the effect described with reference to the plasma display device in the sixth and seventh embodiments.

Fourth Embodiment of Driving Method

Next, in relation to the plasma display devices according to the sixth to eighth embodiments, a fourth embodiment of the driving method will be described.

Figure 17:
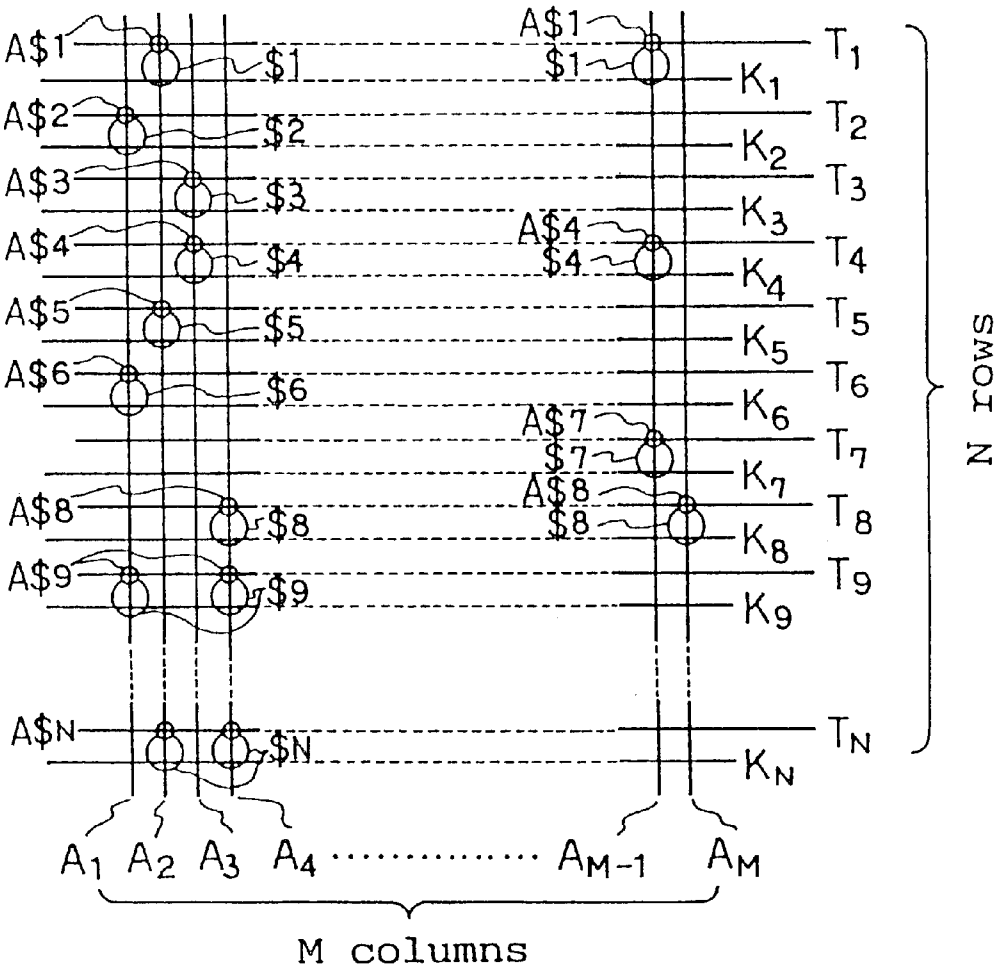
FIG. 17 is a matrix wiring diagram for the device in the sixth to eighth embodiments of the present invention.
Figure 18:
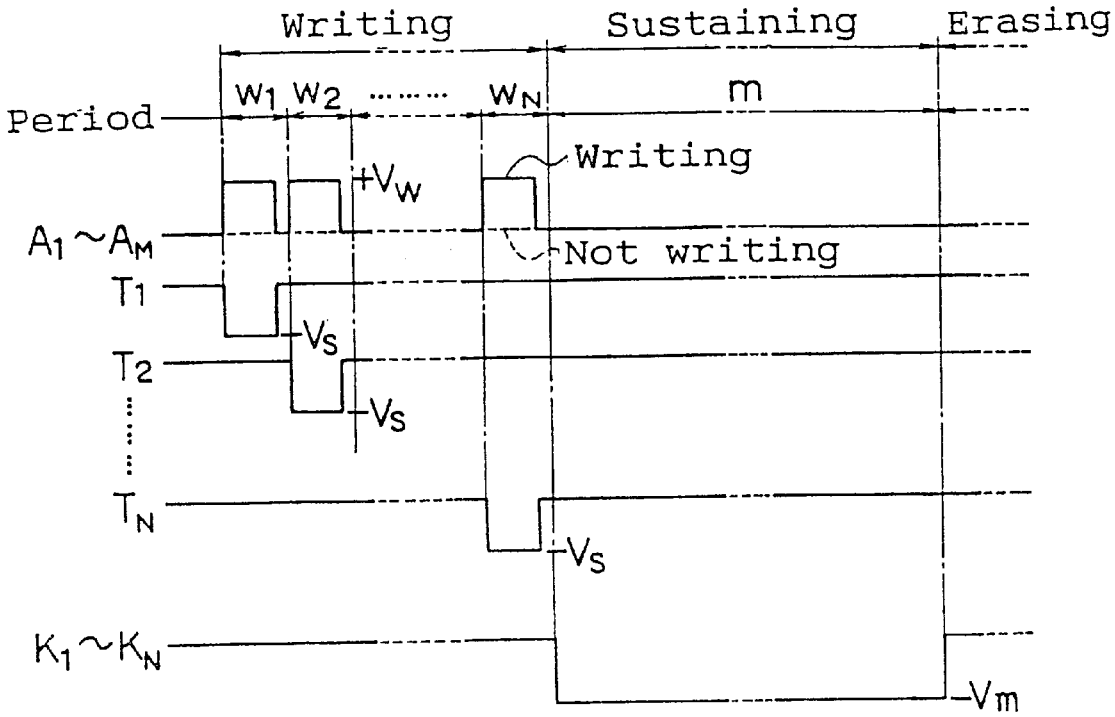
FIG. 18 is a timing chart of the driving voltage in a fourth embodiment of driving method for a plasma display device in the present invention.

The plasma display device according to the sixth to eighth embodiments shown in FIG. 15, the device having the configuration of FIG. 15 partially combined with the structure of FIG. 4, and the device shown in FIG. 16 are formed to have a matrix wiring arrangement as shown in FIG. 17. There are N rows of address electrodes (22) $T_1$ to $T_N$ and N rows of cathode buses (28) $K_1$ to $K_N$. On the other hand, there are M columns of anodes (24) $A_1$ to $A_M$. FIG. 18 is an operation timing chart for the driving voltage. The operation of displaying a dynamic picture such as TV image will be explained with reference to these diagrams.

During the writing period $w_1$ of FIG. 18, a scanning pulse voltage $-V_s$ [V] is applied to the address electrode $T_1$ in the first scanning cycle, while at the same time applying a writing pulse voltage $+V_w$ [V] to certain ones of the anodes $A_1$ to $A_M$ which correspond to the discharge cell $1 to be lit for display. As a result, the writing discharge occurs at the writing position A$1 (FIG. 17). Thus, positive charge is accumulated in the face of the dielectric layer 23 or in the face of the phosphor layer 33 on the face of the dielectric layer 23 around the anodes in the vicinity of the same position A$1. The writing discharge is automatically stopped, while the display content for the first line is stored in the face. The illumination of this writing discharge is very small as compared with the display illumination.

During the subsequent writing period $w_2$, a scanning pulse voltage $-V_s$ [V] is applied to the address electrode $T_2$ in the second scanning cycle, while at the same time applying a writing pulse voltage $+V_w$ [V] to certain ones of the anodes $A_1$ to $A_M$ which correspond to the discharge cells $2 to be lit for display. Consequently, a writing discharge occurs at the writing position A$2. Positive charge is stored in the face of the dielectric layer 23 or in the face of the phosphor layer 33 on the face of the dielectric layer 23 around the anodes in the vicinity of the same position A$2. The writing discharge is automatically stopped, and the display content for the second line is stored in the faces described above. The illumination of this writing discharge is very small as compared with the display illumination.

This operation is repeated sequentially in the subsequent scanning cycles. During the last waiting period $w_N$, a writing discharge occurs at the writing position A$N. Positive charge is stored in the face of the portions of the dielectric layer 23 or in the face of the phosphor layer 33 on the face of the dielectric layer 23 around the anodes in the vicinity of the position A$N. Thus, the display content on one complete field is stored in the faces of the dielectric layer 23. In the process, the face potential of the face of the dielectric layer 23 or the phosphor layer 33 on the face of the dielectric layer 23 around the anodes in the vicinity of the writing positions A$1 to A$N is held at a high positive voltage level.

Next, a DC negative sustaining voltage $-V_m$ [V] is applied to all the cathode buses $K_1$ to $K_N$, and 0 [V ] to all the anodes $A_1$ to $A_M$ during the sustaining period m. Consequently, all the anodes $A_1$ to $A_M$ have a high positive voltage with respect to all the cathode buses $K_1$ to $K_N$. Also, the face of the dielectric layer 23 or the phosphor face 33 on the face of the dielectric layer 23, in which the positive charge is accumulated, has an even higher positive potential with respect to all the cathode buses $K_1$ to $K_N$.The positive charge stored in the face of the dielectric layer 23 or in the face of the phosphor layer 33 on the face of the dielectric layer 23 triggers an auxiliary discharge toward the cathodes 27 disposed opposite to t he particular faces. This auxiliary discharge induces the discharge current flow from the anodes of the display discharge cells $1 to $N to the cathode buses 28 through the cathodes 27 and the resistors 26. Thus, a sustained discharge occurs as the main discharge, thereby displaying a field of image. Then, the voltage application to all the cathode buses $K_1$ to $K_N$ is stopped, and thereby the sustained discharge is stopped. A dynamic image can be displayed by repeating a similar operation for the second and subsequent fields sequentially.

As is apparent from the foregoing description, the present embodiment has the feature that the writing operation can be performed independently of the sustaining operation, and the sustained discharge is effected by applying a DC voltage.

The grayscale display of TV images using this embodiment is identical to the grayscale display of TV images using the first embodiment of the driving method, and therefore it will not be described any more.

In this way, according to this embodiment, the image display of 256 gradations is possible with a small power consumption and a high luminance. Also, according to this embodiment, a current capacity of the power supply for supplying a sustained discharge current can be reduced by half.

Fifth Embodiment of Driving Method

Next, a method of driving a plasma display device in a fifth embodiment will be explained.

Figure 19:
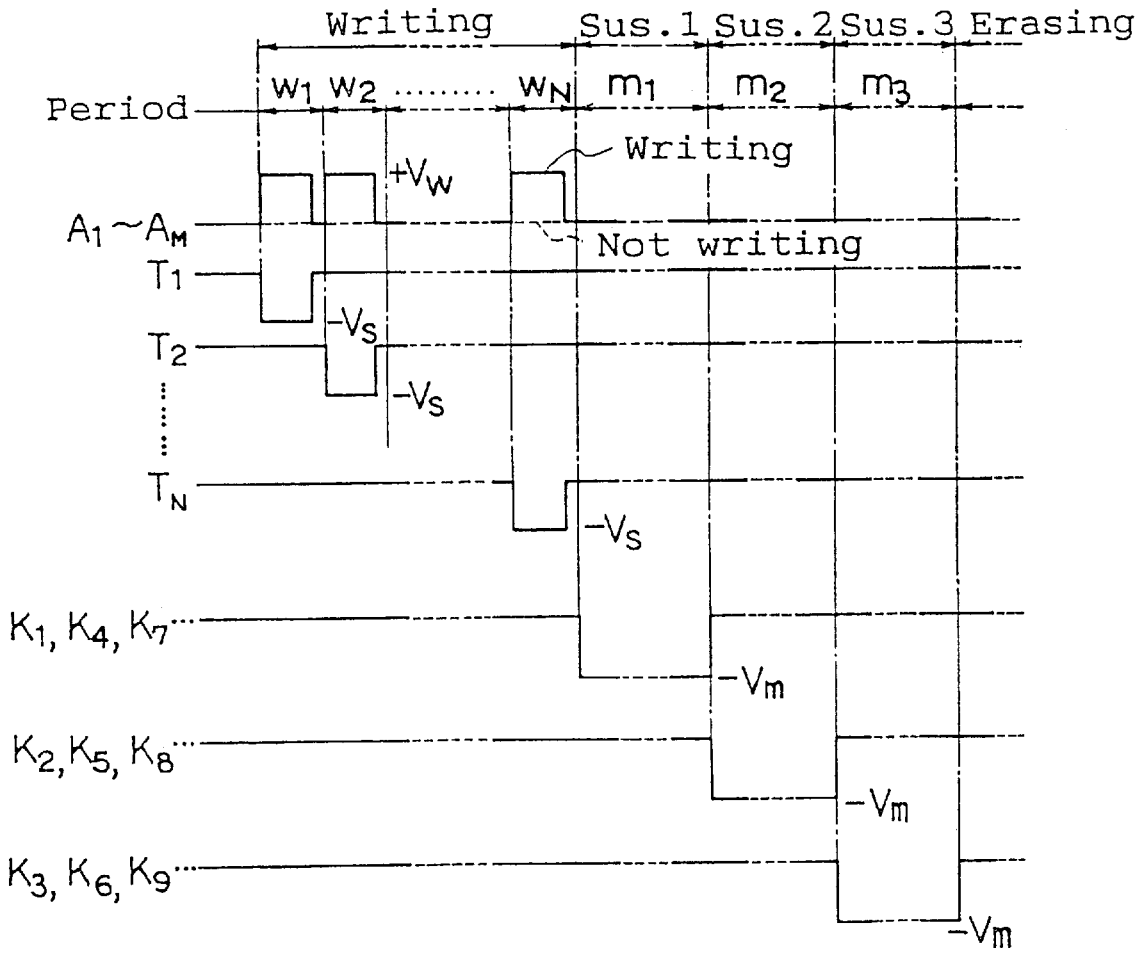
FIG. 19 is a timing chart of the driving voltage in a fifth embodiment of driving method for a plasma display device in the present invention.
Figure 20:
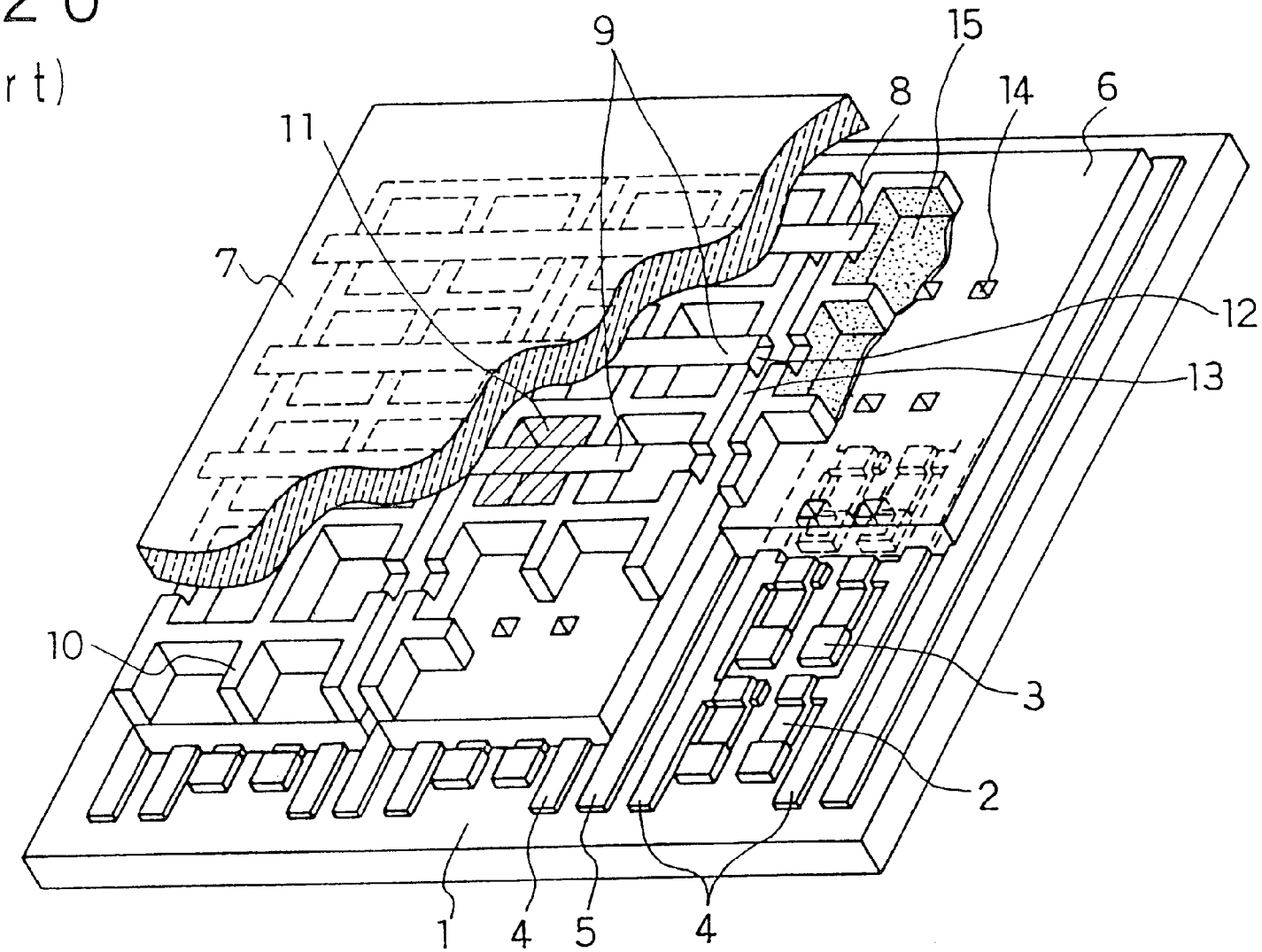
FIG. 20 (Prior Art)
FIG. 20 is a perspective view showing the conventional plasma display device.
Figure 21:
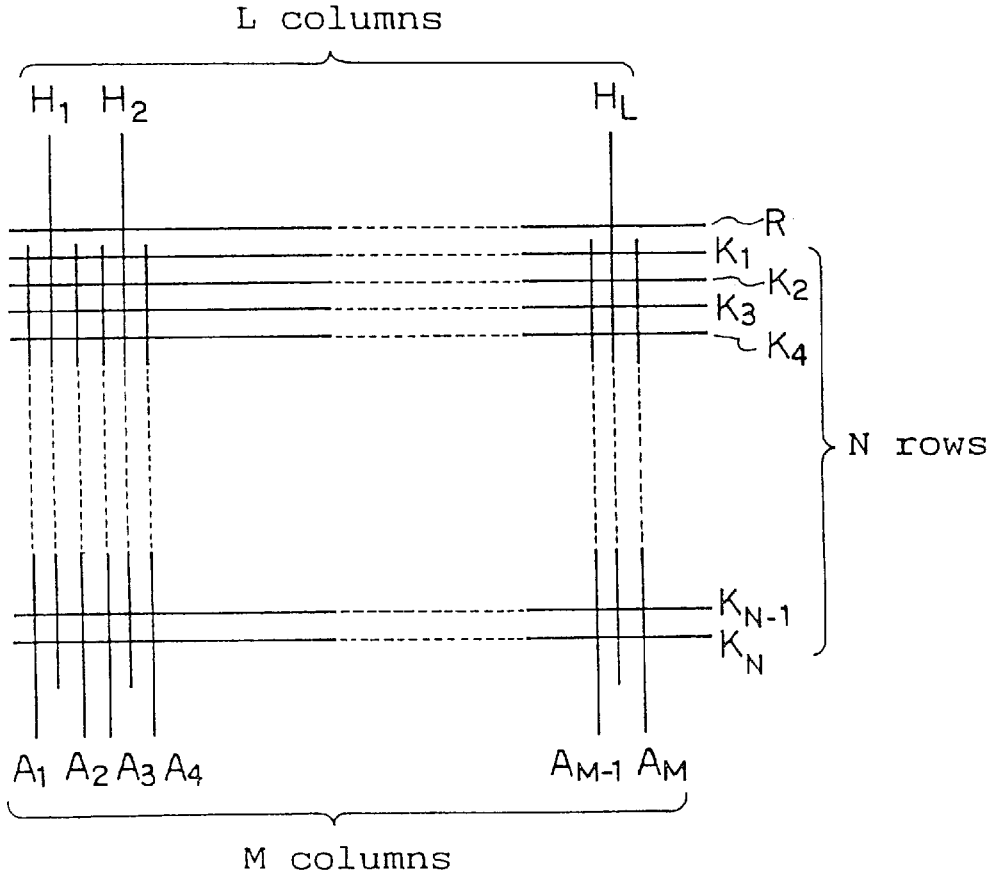
FIG. 21 (Prior Art)
FIG. 21 is a matrix wiring diagram for the conventional plasma display device.

As compared with the fourth embodiment of the driving method, this embodiment is different only in the operation timing of the driving voltage. FIG. 19 is an operation timing chart of the driving voltage.

During the writing period $w_1$ in FIG. 19, a scanning pulse voltage $-V_s$ [V] is applied to the address electrodes $T_1$ in the first scanning cycle, while at the same time applying a writing pulse voltage $+V_w$ [V] to certain ones of the anodes $A_1$ to $A_M$ which correspond to the discharge cells $1 to be lit for display. As a result, a writing discharge occurs at the writing position A$1. A positive charge is stored in the face of the dielectric layer 23 or in the face of the phosphor layer 33 on the face of the dielectric layer 23 around the anode in the vicinity of the same position A$1. The writing discharge is thus automatically stopped, and the display content for the first line is stored in the particular faces. The illumination of this writing discharge is very small as compared with the display illumination.

During the subsequent writing period $w_2$, a scanning pulse voltage $-V_s$ [V] is applied to the address electrode $T_2$ in the second scanning cycle, while at the same time applying a writing pulse voltage $+V_w$ [V] to certain ones of the anodes $A_1$ to $A_M$ which correspond to the discharge cells $2 to be lit for display. A writing discharge occurs at the writing position A$2. Positive charge is accumulated in the face of the dielectric layer 23 or in the face of the phosphor layer 33 on the face of the dielectric layer 23 around the anode in the vicinity of the same position A$2. The writing discharge is automatically stopped, and the display content for the second line is stored in the particular faces. The illumination of this writing discharge is very small as compared with the display illumination.

In the successive scanning cycles, this operation is sequentially repeated. During the last writing period $w_N$, a writing discharge occurs at the writing position A$N. Positive charge is stored in the face of the dielectric layer 23 or in the face of the phosphor layer 33 on the face of the dielectric layer 23 around the anode in the vicinity of the same position A$N. The display content for one complete screen is thus stored in the face of the dielectric layer 23. In the process, the face potential of the dielectric layer 23 or the phosphor layer 33 on the face of the dielectric layer 23 around the anode in the vicinity of the writing positions A$1 to A$N is held at a high positive level.

During the sustaining period $m_1$, a negative sustaining voltage $-V_m$ [V] is applied to the cathode buses $K_1$,$K_4$, $K_7$, . . . which constitute a subgroup 1, and 0 [V] to all the anodes $A_1$ to $A_M$. The result is that a high positive voltage appears in all the anodes $A_1$ to $A_M$ and the face of the dielectric layer 23 or the face of the phosphor layer 33 on the face of the dielectric layer 23 which correspond to the subgroup 1. The positive charge stored in the face of the dielectric layer 23 or in the face of the phosphor layer 33 on the face of the dielectric layer 23 triggers an auxiliary discharge toward the cathodes 27 of the cathode buses $K_1$, $K_4$, $K_7$, . . . of the subgroup 1 disposed opposite to the particular faces. This auxiliary discharge induces a discharge current flow from the anodes of the display discharge cells $1, $4, $7, . . . corresponding to the subgroup 1 through the cathodes 27 and the resistors 26 to the cathode buses 28. In this way, a sustained discharge occurs as the main discharge, so that a field of image is displayed for the display discharge cells $1, $4, $7, . . . corresponding to the subgroup 1. When the voltage application to the cathode buses $K_1$, $K_4$, $K_7$, . . . of the subgroup 1 is stopped, the sustained discharge ceases.

During the next sustaining period $m_2$, a DC negative sustaining voltage $-V_m$ [V] is applied to the cathode buses $K_2$, $K_5$, $K_8$, . . . which constitute a subgroup 2 and 0 [V] to all the anodes $A_1$ to $A_M$. A high positive voltage appears in all the anodes $A_1$ to $A_M$ and the face of the dielectric layer 23 or the face of the phosphor layer 33 on the face of the dielectric layer 23 corresponding to the subgroup 2. The positive charge stored in the face of the dielectric layer 23 or in the face of the phosphor layer 33 on the face of the dielectric layer 23 triggers an auxiliary discharge toward the cathodes 27 of the cathode buses $K_2$, $K_5$, $K_8$, . . . of the subgroup 2 disposed opposite to the particular faces. This auxiliary discharge induces a discharge current flow from the anodes of the display discharge cells $2, $5, $8, . . . corresponding to the subgroup 2 through the resistors 26 and the cathodes 27 to the cathode buses 28. In this way, a sustained discharge occurs as the main discharge, thereby displaying a field of image for the display discharge cells $2, $5, $8, . . . corresponding to the subgroup 2. When the voltage application to the cathode buses $K_2$, $K_5$, $K_8$, . . . of the subgroup 2 is stopped, the sustained discharge ceases.

During the sustaining period $m_3$, a DC negative sustaining voltage $-V_m$ [V] is applied to the cathode buses $K_3$, $K_6$, $K_9$, . . . constituting a subgroup 3 and a voltage of 0 [V] to all the anodes $A_1$, to $A_M$. As a result, all the anodes $A_1$ to $A_M$ and the face of the dielectric layer 23 or the face of the phosphor layer 33 on the face of the dielectric layer 23 that correspond to the subgroup 3 have a high positive voltage. The positive charge stored in the face of the dielectric layer 23 or in the face of the phosphor layer 33 on the face of the dielectric layer 23 triggers an auxiliary discharge toward the cathode buses $K_3$, $K_6$, $K_9$, . . . of the subgroup 3 disposed opposite to the particular faces. This auxiliary discharge induces a discharge current flow from the anodes of the display discharge cells $3, $6, $9 and so on corresponding to the subgroup 3 through the cathodes 27 and the resistors 26 to the cathode buses 28, and a sustained discharge occurs as the main discharge. A field of image for the display discharge cells $3, $6, $9 and so on corresponding to the subgroup 3 is displayed. When the voltage application to the cathode buses $K_3$, $K_6$, $K_9$, . . . of the subgroup 3 is stopped, the sustained discharge ceases.

A similar operation is sequentially repeated for the second and subsequent fields, and image sequence can thus be displayed.

The operation is described above concerning the case in which the cathode buses are divided into subgroup 1, subgroup 2 and subgroup 3. A similar operation can be applied to the case which the cathode buses are divided into subgroups in different way.

As obvious from the foregoing description, this embodiment has the feature that the writing operation and the sustaining operation can be performed independently of each other for each subgroup, and the sustaining discharge is effected by application of a DC voltage.

Next, a grayscale display of TV images according to the above-mentioned embodiment will be described as an example effectively utilizing the above-mentioned feature.

The grayscale display operation of TV images in the example is exactly identical to that shown in graph (a) of FIG. 14. More specifically, the image display involves 500 TV lines, 256 gradations, and a field period of ⅙ second, and each field is temporally divided into eight subfields. The writing operation and three subgroups of the sustaining operation are performed sequentially for each subfield.

Consequently, the power consumption due to discharge remains unchanged as described above, and the luminance can be increased by a factor of 2. Also, the reactive power loss due to the reactive current caused by the sustaining pulse voltage is about 1/100 of the value in the conventional art.

According to the present embodiment, therefore, an image display of 256 gradations is possible with a high luminance and small power consumption.

Further, the maximum value of the sustained discharge current is about double the average value thereof, that is, one half of the conventional value.

According to this embodiment, the current capacity of the power supply for supplying a sustained discharge current can be reduced by one half.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A method for driving a plasma display device having a three-dimensional matrix wiring arrangement of anodes, cathodes and address electrodes, comprising the steps of:

applying a scanning pulse voltage to said anodes and a writing pulse voltage to said address electrodes, thereby to cause writing discharge and temporarily store writing charge on a dielectric layer around said anodes;

discharging said writing charge as an auxiliary discharge by applying a direct current (DC) sustaining voltage to said cathodes; and inducing main discharge between said anodes and said cathodes by said auxiliary discharge and sustaining said discharge by applying the DC sustaining voltage.

2. A method for driving a plasma display device in accordance with claim 1, wherein the sustaining voltage is applied to all the cathodes simultaneously after the writing charge is accumulated on said dielectric layer around all the cathodes.

3. A method for driving a plasma display device in accordance with claim 1, wherein the sustaining voltage is applied to each of said cathodes independently as soon as the writing charge is accumulated on said dielectric layer around each of said anodes.

4. A method for driving a plasma display device in accordance with claim 1, wherein in the step of discharging, the sustaining voltage is sequentially applied to a plurality of small groups of said cathodes having a configuration of a plurality of rows, and thereby performing the main discharge between each small group of cathodes impressed with the sustaining voltage and corresponding anodes.

5. A method for driving a plasma display device having a three-dimensional matrix wiring arrangement of anodes, cathodes and address electrodes, comprising the steps of:

applying a scanning pulse voltage to said address electrodes and a writing pulse voltage to said anodes, thereby to cause writing discharge and temporarily store writing charge on a dielectric layer around the anodes;

discharging said writing charge as an auxiliary discharge by applying a direct current (DC) sustaining voltage to said cathodes; and inducing main discharge between said anodes and said cathodes by said auxiliary discharge and sustaining said main discharge by applying the DC sustaining voltage.

6. A method for driving a plasma display device in accordance with claim 5, wherein the sustaining voltage is applied to all the cathodes simultaneously after the writing charge is accumulated on said dielectric layer around all the anodes.

7. A method for driving a plasma display device in accordance with claim 5, wherein in the step of discharging, the sustaining voltage is sequentially applied to a plurality of small groups of said cathodes having a configuration of a plurality of rows, and thereby performing the main discharge between each small group of cathodes impressed with the sustaining voltage and corresponding anodes.

* * * * *